US010140935B2

(12) United States Patent
Son et al.

(10) Patent No.: US 10,140,935 B2
(45) Date of Patent: Nov. 27, 2018

(54) DISPLAY APPARATUS DRIVEN IN AN INVERSION DRIVING MANNER AND METHOD OF PROCESSING DATA THEREOF

(71) Applicant: Samsung Display Co., LTD., Yongin, Gyeonggi-Do (KR)

(72) Inventors: Seokyun Son, Yongin-si (KR); Kuk-Hwan Ahn, Hwaseong-si (KR); BongHyun You, Yongin-si (KR); Jai-Hyun Koh, Hwaseong-si (KR); Sungjae Park, Gangwon-do (KR); Dong-Won Park, Hwaseong-si (KR); Iksoo Lee, Seoul (KR); Seokha Hong, Yongin-si (KR)

(73) Assignee: Samsung Display Co., Ltd. (KR)

( * ) Notice: Subject to any disclaimer, the term of this patent is extended or adjusted under 35 U.S.C. 154(b) by 432 days.

(21) Appl. No.: 14/839,653

(22) Filed: Aug. 28, 2015

(65) Prior Publication Data

US 2016/0189641 A1 Jun. 30, 2016

(30) Foreign Application Priority Data

Dec. 30, 2014 (KR) ..... 10-2014-0194159

(51) Int. Cl.
*G09G 3/36* (2006.01)

(52) U.S. Cl.
CPC ..... *G09G 3/3607* (2013.01); *G09G 3/3614* (2013.01); *G09G 3/3648* (2013.01);
(Continued)

(58) Field of Classification Search
CPC .. G02F 1/1368; G09G 3/3611; G09G 3/3648; G09G 3/2011; G09G 3/36; G09G 3/3607;
(Continued)

(56) References Cited

U.S. PATENT DOCUMENTS 5,300,942 A 4/1994 Dolgoff
6,552,706 B1 4/2003 Ikeda et al.
(Continued)

FOREIGN PATENT DOCUMENTS

KR 10-2011-0046544 5/2011
KR 10-2011-0077899 7/2011
(Continued)

*Primary Examiner* — Jennifer Mehmood
*Assistant Examiner* — James Nokham
(74) *Attorney, Agent, or Firm* — Innovation Counsel LLP

(57) ABSTRACT

A display apparatus includes a liquid crystal panel including gate lines, data lines, and pixels, a gate driver, a data driver, and a timing controller. The pixels include first and second pixels. The first and second pixels are arranged in pixel rows adjacent to each other, arranged in different pixel columns, connected to the same gate line, display the same color, and receive data voltages having different polarities from each other. The image data include first pixel data displayed in the first pixels and second pixel data displayed in the second pixels. When the first pixel data have a first grayscale value and the second pixel data have a second grayscale value different from the first grayscale value, the timing controller modulates the first and second pixel data to allow the first and second pixel data to have a grayscale value between the first and second grayscale values.

19 Claims, 22 Drawing Sheets

(52) U.S. Cl.
CPC ..... *G09G 2300/0426* (2013.01); *G09G 2300/0452* (2013.01); *G09G 2320/0209* (2013.01); *G09G 2320/0233* (2013.01)

(58) Field of Classification Search
CPC ..... G09G 3/3614; G09G 2300/0452; G09G 2320/0209; H04N 1/4092
See application file for complete search history.

(56) References Cited

U.S. PATENT DOCUMENTS

| | | | | |
|---|---|---|---|---|
| 8,587,504 | B2 | 11/2013 | Joo | |
| 2004/0095521 | A1* | 5/2004 | Song | G02F 1/133514 349/61 |
| 2004/0246404 | A1* | 12/2004 | Elliott | G02F 1/1368 349/88 |
| 2006/0202927 | A1* | 9/2006 | Lee | G02F 1/1368 345/88 |
| 2008/0001889 | A1* | 1/2008 | Chun | G09G 3/2011 345/96 |
| 2010/0013749 | A1* | 1/2010 | Huang | G09G 3/3648 345/89 |
| 2010/0164985 | A1* | 7/2010 | Kim | G09G 3/3614 345/618 |
| 2011/0292099 | A1* | 12/2011 | Kim | G09G 3/3614 345/691 |
| 2013/0070304 | A1* | 3/2013 | Suzuki | H04N 1/4092 358/3.27 |
| 2013/0321253 | A1* | 12/2013 | Park | G09G 3/3611 345/100 |
| 2014/0184580 | A1* | 7/2014 | Cho | G09G 3/3614 345/212 |

FOREIGN PATENT DOCUMENTS

| | | |
|---|---|---|
| KR | 10-2013-0076864 | 7/2013 |
| KR | 10-2014-0006490 | 9/2014 |
| KR | 10-2015-0139132 | 12/2015 |

* cited by examiner

DISPLAY APPARATUS DRIVEN IN AN INVERSION DRIVING MANNER AND METHOD OF PROCESSING DATA THEREOF

CROSS-REFERENCE TO RELATED APPLICATION

This U.S. non-provisional patent application claims priority under 35 U.S.C. § 119 to Korean Patent Application No. 10-2014-0194159, filed on Dec. 30, 2014, the contents of which are hereby incorporated by reference in its entirety.

BACKGROUND

1. Field of Disclosure

The present disclosure relates to a display apparatus and a method of processing data for the display apparatus. More particularly, the present disclosure relates to a display apparatus driven in an inversion driving manner and a method of processing data for the display apparatus.

2. Description of the Related Art

A liquid crystal display forms an electric field in a liquid crystal layer disposed between two substrates and changes an alignment of liquid crystal molecules of the liquid crystal layer to control a transmittance of light passing through the liquid crystal layer, and thus a desired image is displayed through the liquid crystal display.

A method of driving the liquid crystal display is classified into a line inversion method, a column inversion method, and a dot inversion method according to a polarity of a data voltage applied to data lines. The line inversion method inverts the polarity of image data applied to data lines every pixel row, the column inversion method inverts the polarity of the image applied to the data lines every pixel column, and the dot inversion method inverts the polarity of the image data applied to the data lines every pixel row and every pixel column.

In general, a display apparatus displays colors using three primary colors of red, green, and blue. Accordingly, the display apparatus includes sub-pixels respectively corresponding to the red, green, and blue colors. In recent years, a display apparatus that displays the colors using red, green, blue, and other primary colors has been developed. As the other primary colors, one or more of the magenta, cyan, yellow, and white colors are used. In addition, in order to improve brightness of the image, a display apparatus including red, blue, green, and white sub-pixels has been suggested. To this end, red, green, and blue image signals from an external source are applied to a display panel after being converted to red, green, blue, and white data signals.

SUMMARY

The present disclosure provides a display apparatus capable of preventing a one-line crosstalk from occurring.

The present disclosure provides a method of processing data of the display apparatus.

Embodiments of the inventive concept provide a display apparatus including a liquid crystal panel, a gate driver, a data driver, and a timing controller. The liquid crystal panel includes a plurality of gate lines extending in a first direction, a plurality of data lines extending in a second direction crossing the first direction, and a plurality of pixels connected to the gate lines and the data lines.

The gate driver applies gate signals to the gate lines and the data driver applies data voltages to the data lines.

The timing controller receives a control signal and image data to apply a gate control signal to the gate driver and to apply a data control signal to the data driver.

The pixels include pixels arranged in a h-th (h is a natural number) row and pixels arranged in a (h+1)th row, which are adjacent to each other in the second direction such that a (k+1)th (k is a natural number) of the gate lines is disposed between the pixels arranged in the h-th row and the pixels arranged in the (h+1)th row.

First pixels displaying a first color and connected to the (k+1)th gate line among the pixels arranged in the h-th row are spaced apart from second pixels displaying the first color and connected to the (k+1)th gate line among the pixels arranged in the (h+1)th row and receive the data voltages having a polarity different from that of the data voltages applied to the second pixels.

The image data include first pixel data displayed in at least a portion of the first pixels and second pixel data displayed in at least a portion of the second pixels.

When the first pixel data have a first grayscale value and the second pixel data have a second grayscale value different from the first grayscale value, the timing controller modulates the first and second pixel data to allow the first and second pixel data to have a grayscale value between the first and second grayscale values.

The timing controller modulates the first pixel data to generate first modulated pixel data having a third grayscale value different from the first and second grayscale values and modulates the second pixel data to generate second modulated pixel data having the third grayscale value.

The third grayscale value corresponds to a half of a sum of the first and second grayscale values.

The timing controller includes a pattern analyzing part, a modulation determining part, and a data modulating part. The pattern analyzing part analyzes a pattern of the image data and determining whether a boundary of the pattern extending in the first direction is disposed between the first and second pixels.

In an embodiment of the inventive concept, the modulation determining part determines whether a number of the first pixels displaying the pattern or a number of the second pixels displaying the pattern is equal to or greater than a reference number.

In an embodiment of the inventive concept, the modulation determining part determines whether sum of gray voltage of the first pixels displaying the pattern or sum of gray voltage of the second pixels displaying the pattern is equal to or greater than a reference voltage The data modulating part modulates the first and second pixel data.

The data modulating part modulates the first and second pixel data when the boundary extending in the first direction of the pattern is disposed between the first and second pixels and the number of the first pixels displaying the pattern or the number of the second pixels displaying the pattern is equal to or greater than the reference number.

The data modulating part does not modulate the first and second pixel data when the boundary extending in the first direction of the pattern is not disposed between the first and second pixels or when the number of the first pixels displaying the pattern or the number of the second pixels displaying the pattern is smaller than the reference number.

When the first grayscale value is not zero and the second grayscale value is zero, the modulation determining part checks whether the number of the first pixels displaying the pattern is equal to or greater than the reference number, and when the second grayscale value is not zero and the first grayscale value is zero, the modulation determining part checks whether the number of the second pixels displaying the pattern is equal to or greater than the reference number.

The first color is a red, green, blue, or white color.

The pixels arranged in the h-th row include a first pixel group and a second pixel group, which are sequentially arranged in the first direction, the pixels arranged in the (h+1)th row include a third pixel group and a fourth pixel group, which are sequentially arranged in the first direction, and each of the first, second, third, and fourth pixel groups includes an even number of pixels.

Each of the first and fourth pixel groups includes two pixels of a red pixel, a green pixel, a blue pixel, and a white pixel, and each of the second and third pixel groups includes the other two pixels of the red pixel, the green pixel, the blue pixel, and the white pixel.

The second pixels are included in the pixels arranged in a (2u+1)th (u is a natural number) column when the first pixels are included in the pixels arranged in a (2u−1)th column, and when the first pixels are included in the pixels arranged in a 2u-th column, the second pixels are included in the pixels arranged in a (2u+2)th column.

Among the pixels arranged in the (2u−1)th (u is a natural number) column, two pixels adjacent to each other in the second direction such that a 2k-th gate line is disposed between the two pixels are commonly connected to the 2k-th gate line, and among the pixels arranged in the 2u-th column, two pixels adjacent to each other in the second direction such that a (2k−1)th gate line is disposed between the two pixels are commonly connected to the (2k−1)th gate line.

Among the pixels arranged in the (2u−1)th (u is a natural number) column, two pixels adjacent to each other in the second direction such that a (2k−1)th gate line is disposed between the two pixels are commonly connected to the (2k−1)th gate line, and among the pixels arranged in the 2u-th column, two pixels adjacent to each other in the second direction such that a 2k-th gate line is disposed between the two pixels are commonly connected to the 2k-th gate line.

The pixels arranged in a u-th (u is a natural number) column, which is disposed between a j-th (j is a natural number) and a (j+1)th data line of the data lines, are alternately connected to the j-th data line and the (j+1)th data line in the unit of at least one pixel.

The polarity of the data voltages applied to the data lines is inverted every at least one data line.

The pixels arranged in the h-th row, which is disposed between a k-th gate line and a (k+1)th gate line of the gate lines, are alternately connected to the k-th gate line and the (k+1)th gate line in the unit of at least one pixel.

Embodiments of the inventive concept provide a method of processing data of a display apparatus, providing a liquid crystal panel including a plurality of gate lines extending in a first direction, a plurality of data lines extending in a second direction crossing the first direction, and a plurality of pixels connected to the gate lines and the data lines, the pixels comprising pixels arranged in a h-th (h is a natural number) row and pixels arranged in a (h+1)th row, which are adjacent to each other in the second direction such that a (k+1)th (k is a natural number) of the gate lines is disposed between the pixels arranged in the h-th row and the pixels arranged in the (h+1)th row, first pixels displaying a first color and connected to the (k+1)th gate line among the pixels arranged in the h-th row being spaced apart from second pixels displaying the first color and connected to the (k+1)th gate line among the pixels arranged in the (h+1)th row and receiving the data voltages having a polarity different from that of the data voltages applied to the second pixels, determining whether a boundary extending in the first direction of a pattern of the image data is disposed between the first and second pixels, determining whether a number of the first pixels displaying the pattern or a number of the second pixels displaying the pattern is equal to or greater than a reference number when the boundary extending in the first direction of the pattern of the image data is disposed between the first and second pixels, and modulating the image data including first pixel data corresponding to the first pixels and having a first grayscale value and second pixel data corresponding to the second pixels and having a second grayscale value when the number of the first pixels or the second pixels displaying the pattern of the image data is equal to or greater than the reference number to generate first modulated pixel data corresponding to the first pixels and having a third grayscale value between the first and second values and second modulated pixel data corresponding to the second pixels and having a fourth grayscale value between the first and second grayscale values.

The third grayscale value is substantially equal to the fourth grayscale value.

The image data are not modulated when the boundary extending in the first direction of the pattern of the image data is not disposed between the first and second pixels or the number of the first pixels displaying the pattern or the number of the second pixels displaying the pattern is smaller than the reference number.

According to the above, the one line crosstalk may be prevented from occurring.

BRIEF DESCRIPTION OF THE DRAWINGS

The above and other advantages of the present disclosure will become readily apparent by reference to the following detailed description when considered in conjunction with the accompanying drawings wherein.

DETAILED DESCRIPTION

Figure 1:
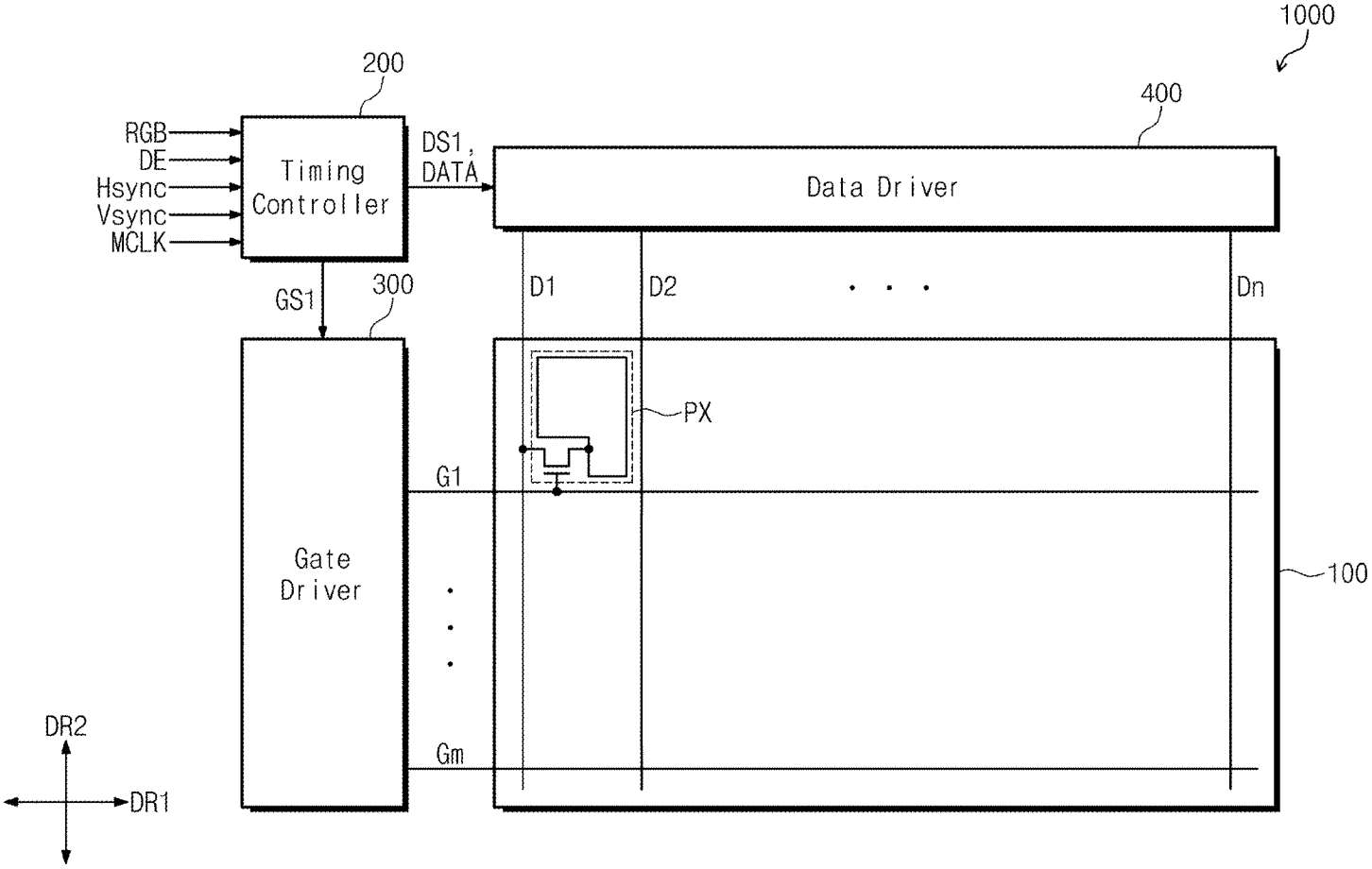
FIG. 1 is a block diagram showing a liquid crystal display device according to an exemplary embodiment of the present disclosure.

It will be understood that when an element or layer is referred to as being "on", "connected to" or "coupled to" another element or layer, it can be directly on, connected or coupled to the other element or layer or intervening elements or layers may be present between the element or layer and the another element or layer. In contrast, when an element is referred to as being "directly on," "directly connected to" or "directly coupled to" another element or layer, there are no intervening elements or layers present. Like numbers refer to like elements throughout the specification. As used herein, the term "and/or" includes any and all combinations of one or more of the associated listed items.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the present inventive concept.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the inventive concept. As used herein, the singular forms, "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this inventive concept belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Hereinafter, the present inventive concept will be explained in detail with reference to the accompanying drawings.

Figure 2:
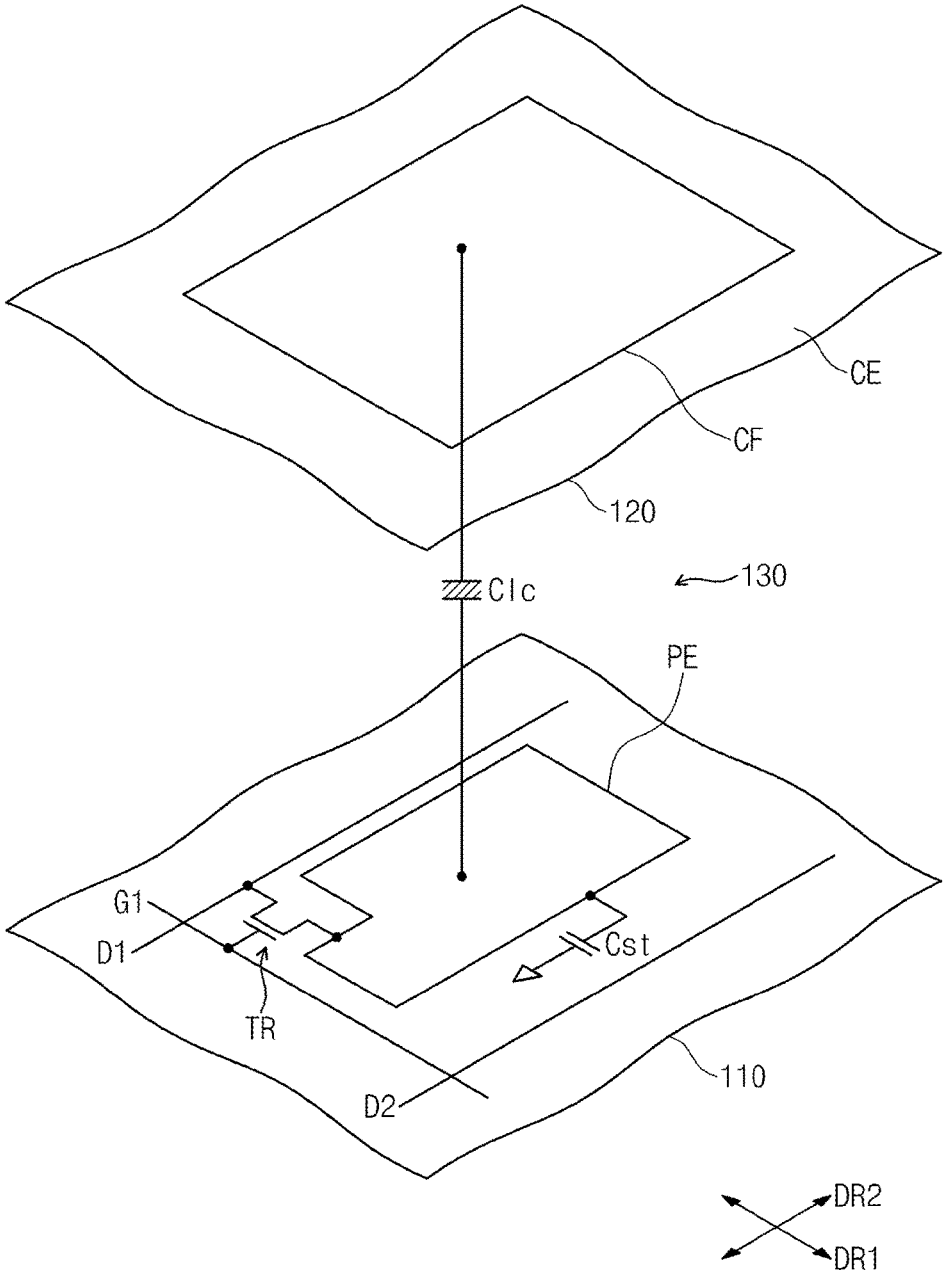
FIG. 2 is an equivalent circuit diagram showing one pixel shown in FIG. 1.

FIG. 1 is a block diagram showing a liquid crystal display device 1000 according to an exemplary embodiment of the present disclosure and FIG. 2 is an equivalent circuit diagram showing one pixel shown in FIG. 1.

Referring to FIG. 1, the liquid crystal display device 1000 includes a liquid crystal panel 100, a timing controller 200, a gate driver 300, and a data driver 400.

The liquid crystal panel 100 includes a lower substrate 110, an upper substrate 120 facing the lower substrate 110, and a liquid crystal layer 130 interposed between the lower and upper substrates 110 and 120.

The display panel 110 includes a plurality of gate lines G1 to Gm extending in a first direction DR1 and a plurality of data lines D1 to Dn extending in a second direction DR2 crossing the first direction DR1. The gate lines G1 to Gm and the data lines D1 to Dn define pixel areas and pixels PXs are respectively disposed in the pixel areas. FIG. 2 shows a pixel PX connected to a first gate line G1 and a first data line D1.

Each pixel PX includes a thin film transistor TR connected to a corresponding gate line of the gate lines G1 to Gm, a liquid crystal capacitor Clc connected to the thin film transistor TR, and a storage capacitor Cst connected to the liquid crystal capacitor Clc in parallel. The storage capacitor Cst may be omitted if necessary. The thin film transistor TR is disposed on the lower substrate 110. The thin film transistor TR includes a gate electrode connected to the first gate line G1, a source electrode connected to the first data line D1, and a drain electrode connected to the liquid crystal capacitor Clc and the storage capacitor Cst.

The liquid crystal capacitor Clc includes a pixel electrode PE disposed on the lower substrate 110 and a common electrode CE disposed on the upper substrate 120 as its two terminals, and the liquid crystal layer 130 disposed between the pixel electrode PE and the common electrode CE serves as a dielectric substance. The pixel electrode PE is connected to the thin film transistor TR and the common electrode CE is disposed on an entire surface of the upper substrate 120 to receive a common voltage. Different from the common electrode CE shown in FIG. 2, the common electrode CE may be disposed on the lower substrate 110 according to embodiments, and in this case, at least one of the pixel electrode PE and the common electrode CE includes slits.

The storage capacitor Cst assists the liquid crystal capacitor Clc and includes the pixel electrode PE, a storage line (not shown), and an insulating layer disposed between the pixel electrode PE and the storage line (not shown). The storage line is disposed on the lower substrate 110 to overlap with a portion of the pixel electrode PE. The storage line is applied with a constant voltage, e.g., a storage voltage.

The pixel PX displays one of primary colors. The primary colors include red, green, blue, and white colors, but they should not be limited thereto or thereby. The primary colors may further include various colors, e.g., cyan, magenta, yellow, etc. The pixel PX may further include a color filter CF to represent one of the primary colors. In FIG. 2, the color filter CF is disposed on the upper substrate 120, but it should not be limited thereto or thereby. That is, the color filter CF may be disposed on the lower substrate 110.

The timing controller 200 receives image data RGB and control signals from an external graphic controller (not shown). The control signals include a vertical synchronization signal as a frame distinction signal Vsync, a horizontal synchronization signal as a row distinction signal Hsync, a data enable signal DE maintained at a high level during a period, in which data are output, to indicate a data input period, and a main clock signal MCLK.

The timing controller 200 analyzes the image data RGB and modulates the image data RGB when determining that the image data RGB are required to be modulated. When no modulation is required for the image data RGB, the timing controller 200 does not modulate the image data RGB.

The timing controller 200 converts the image data RGB or the modulated image data in consideration of specifications of the data driver 400. The timing controller 200 applies the converted data DATA to the data driver 400. The timing controller 200 generates a gate control signal GS1 and a data control signal DS1. The gate control signal GS1 is applied to the gate driver 300 and the data control signal DS1 is applied to the data driver 400.

The gate control signal GS1 is used to drive the gate driver 300 and the data control signal DS1 is used to drive the data driver 400.

The gate driver 300 generates gate signals in response to the gate control signal GS1 and applies the gate signals to the gate lines G1 to Gm. The gate control signal GS1 includes a scan start signal indicating a start of scanning, at least one clock signal controlling an output period of a gate on voltage, and an output enable signal controlling the maintaining of the gate on voltage.

The data control signal DS1 generates grayscale voltages corresponding to the image data DATA in response to the data control signal DS1 and applies the grayscale voltages to the data lines D1 to Dn as data voltages. The data voltages include a positive (+) data voltage having a positive value with respect to the common voltage and a negative (−) data voltage having a negative value with respect to the common voltage. The data control signal DS1 includes a horizontal start signal STH indicating a start of transmitting of the image data DATA to the data river 400, a load signal indicating application of data voltages to the data lines D1 to Dn, and a polarity control signal inverting a polarity of the data voltages with respect to the common voltage.

The polarity of the data voltages applied to the pixels PX is inverted every frame period to prevent liquid crystals from burning or deteriorating. For instance, the data driver 400 inverts the polarity of the data voltages every frame period in response to the polarity control signal. In addition, when the image corresponding to one frame is displayed, the data voltages having different polarities are output in the unit of at least one data line and applied to the pixels to improve display quality.

Each of the timing controller 200, the gate driver 300, and the data driver 400 may be directly mounted on the liquid crystal panel 100, attached to the liquid crystal panel 100 in a tape carrier package after being mounted on a flexible printed circuit board, or mounted on a separate printed circuit board. As another way, at least one of the gate driver 300 and the data driver 400 may be integrated on the liquid crystal panel 100 together with the gate lines G1 to Gm, the data lines D1 to Dn, and the thin film transistor TR. In addition, the timing controller 200, the gate driver 300, and the data driver 400 may be integrated in a single chip.

Figure 3:
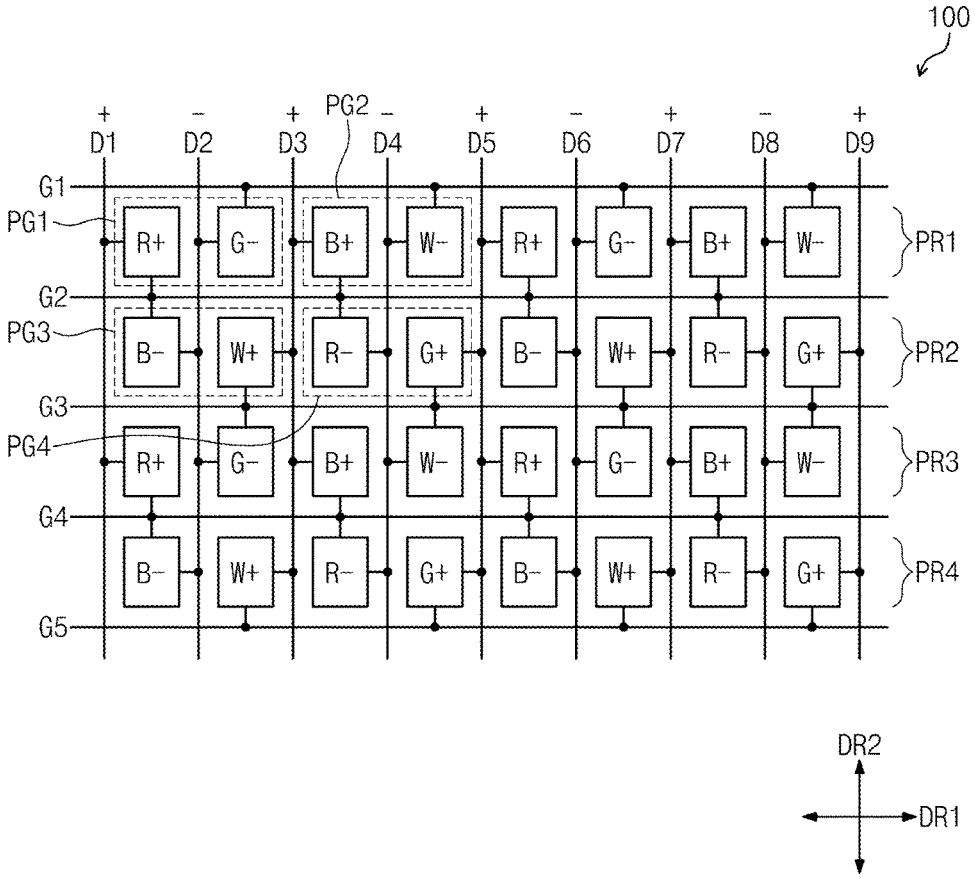
FIG. 3 is a plan view showing a portion of a liquid crystal panel according to an exemplary embodiment of the present disclosure.

FIG. 3 is a plan view showing a portion of a liquid crystal panel according to an exemplary embodiment of the present disclosure.

Referring to FIG. 3, the pixels include pixels arranged in a h-th (h is a natural number) row and pixels arranged in a (h−1)th row. A first pixel row PR1 and a second pixel row PR2 are disposed adjacent to each other in the second direction DR2 such that a (k+1)th (k is a natural number) gate line among the gate lines G1 to Gm is disposed between the first and second pixel rows PR1 and PR2. FIG. 3 shows first, second, third, and fourth pixel rows PR1, PR2, PR3, and PR4 and two pixel rows adjacent to each other in the second direction DR2 have the same structure. Hereinafter, the first and second pixel rows PR1 and PR2 will be described in detail with reference to FIG. 3 when assuming that each of k" and "h" is 1.

The first pixel row PR1 includes a first pixel group PG1 and a second pixel group PG2 sequentially arranged in the first direction DR1. The second pixel row PR2 includes a third pixel group PG3 and a fourth pixel group PG4 sequentially arranged in the first direction DR1. Each of the first to fourth pixel groups PG1 to PG4 includes an even number of the pixels. In FIG. 3, each of the first to fourth pixel groups PG1 to PG4 includes two pixels.

Each of the first to fourth pixel groups PG1 to PG4 displays a portion of the primary colors. Each of the first and fourth pixel groups PG1 and PG4 includes a red pixel and a green pixel. Each of the second and third pixel groups PG2 and PG3 includes a blue pixel and a white pixel.

The first to fourth pixel groups PG1 to PG4 may be repeatedly arranged.

In FIG. 3, the red, green, blue, and white pixels are indicated by "R", "G", "B", and "W", respectively. The pixels applied with the data voltages having the positive (+) polarity during an i-th (i is a natural number) frame period are represented by "R+", "G+", "B+", and "W+", respectively, and the pixels applied with the data voltages having the negative (−) polarity during the i-th frame period are represented by "R−", "G−", "B−", and "W−", respectively.

The polarities of the data voltages applied to the pixels of the liquid crystal panel 100 shown in FIG. 3 indicate polarities of the data voltages during the i-th frame period. The polarities of the data voltages are inverted during an (i+1)th frame period. That is, the data driver 400 shown in FIG. 1 inverts the polarities of the data voltages applied to the data lines D1 to Dn at every frame period.

Meanwhile, the arrangement of the pixels should not be limited to that shown in FIG. 3. That is, positions of the red, green, blue, and white pixels may be various forms in each of the first and second pixel rows PR1 and PR2. In detail, each of the first and second pixel groups PG1 and PG2 may include the green and white pixels. In addition, each of the first and fourth pixel groups PG1 and PG4 may include the red and white pixels and each of the second and fourth pixel groups PG2 and PG3 may includes the green and blue pixels.

In the present exemplary embodiment, the polarity of the data voltages applied to the data lines D1 to D9 is inverted every data line. As shown in FIG. 3, the positive data voltage is applied to odd-numbered data lines D1, D3, D5, D7, and D9 and the negative data voltage is applied to even-numbered data lines D2, D4, D6, and D8.

The pixels arranged in an u-th (u is a natural number) column disposed between a j-th (j is a natural number) data line and a (j+1)th data line are alternately connected to the j-th data line and the (j+1)th data line in the unit of at least one pixel. Hereinafter, the pixels disposed between the first data line D1 and the second data line D2 will be described in detail when assuming that each of "j" and "u" is 1.

The pixels arranged in a first column between the first and second data lines D1 and D2 are alternately connected to the first and second data lines D1 and D2 in the unit of at least one pixel. In other words, the pixels arranged in the same column are alternately connected to a left data line and a right data line in the unit of one row. The red pixel R+ of the first pixel group PG1 is connected to the first data line D1 and the blue pixel B− of the third pixel group PG3 is connected to the second data line D2.

In the present exemplary embodiment, two pixels adjacent to each other in the second direction DR2 among the pixels arranged in a (2u−1)th column such that a 2k-th gate line is disposed between the two pixels are commonly connected to a 2k-th gate line. In addition, two pixels adjacent to each other in the second direction DR2 among the pixels arranged in a 2u-th column such that a (2k−1)th gate line is disposed between the two pixels are commonly connected to a (2k−1)th gate line.

In detail, among the pixels arranged in the first column, the red and blue pixels R+ and B− adjacent to each other such that the second gate line G2 is disposed between the red and blue pixels R+ and B− are commonly connected to the second gate line G2, and among the pixels arranged in the third column, the red and blue pixels R− and B+ adjacent to each other such that the second gate line G2 is disposed between the red and blue pixels R− and B+ are commonly connected to the second gate line G2. Accordingly, the red and blue pixels R+ and B− arranged in the first column and connected to the second gate line G2 are driven in response to the gate signal applied to the second gate line G2. The red and blue pixels R− and B+ arranged in the third column and connected to the second gate line G2 are driven in response to the gate signal applied to the second gate line G2.

In addition, among the pixels arranged in the second column, the white and green pixels W+ and G− adjacent to each other such that the third gate line G3 is disposed between the white and green pixels W+ and G− are commonly connected to the third gate line G3, and among the pixels arranged in the fourth column, the white and green pixels W− and G+ adjacent to each other such that the third gate line G3 is disposed between the white and green pixels W− and G+ are commonly connected to the third gate line G3. Accordingly, the white and green pixels W+ and G− arranged in the second column and connected to the third gate line G3 are driven in response to the gate signal applied to the third gate line G3. The white and green pixels W− and G+ arranged in the fourth column and connected to the third gate line G3 are driven in response to the gate signal applied to the third gate line G3.

According to another embodiment, two pixels adjacent to each other in the second direction DR2 among the pixels arranged in a (2u−1)th column such that the (2k−1)th gate line is disposed between the two pixels are commonly connected to the (2k−1)th gate line. In addition, two pixels adjacent to each other in the second direction DR2 among the pixels arranged in the 2u-th column such that the 2k-th gate line is disposed between the two pixels are commonly connected to the 2k-th gate line.

According to the present exemplary embodiment, first pixels displaying a first color and connected to the k-th gate line among the pixels arranged in the h-th row receive the data voltage having the polarity different from that of the data voltage applied to second pixels displaying the first color and connected to the k-th gate line among the pixels arranged in the (h+1)th row. The first pixels and the second pixels are spaced apart from each other in the first direction DR1. The first pixels and the second pixels are spaced apart from each other such that the pixels arranged in an odd number of columns are disposed between the first and second pixels. That is, the column of each of the first pixels may be different from the column of each of the second pixels.

The first color may be one of the red, green, blue, and white colors.

In the first to fourth pixel groups PG1 to PG4, when the first pixel is included in the first pixel group PG1, the second pixel is included in the fourth pixel group PG4. According to another embodiment, when the first pixel is included in the second pixel group PG2, the second pixel is included in the third pixel group PG3. In other words, when the first pixel is included in the pixels arranged in the (2u−1)th column, the second pixel is includes in the pixels arranged in the (2u+1)th column. In addition, when the first pixel is included in the pixels arranged in the 2u-th column, and the second pixel is included in the pixels arranged in a (2u−2)th column.

When the first color is the red and each of the first and second pixels is the red pixel, the red pixels R+ arranged in the first pixel row PR1 and the red pixels R− arranged in the second pixel row PR2 are connected to the second gate line G2, but the red pixels R+ arranged in the first pixel row PR1 receive the data voltages having the polarity different from that of the data voltages applied to the red pixels R− arranged in the second pixel row PR2.

Figure 4A:
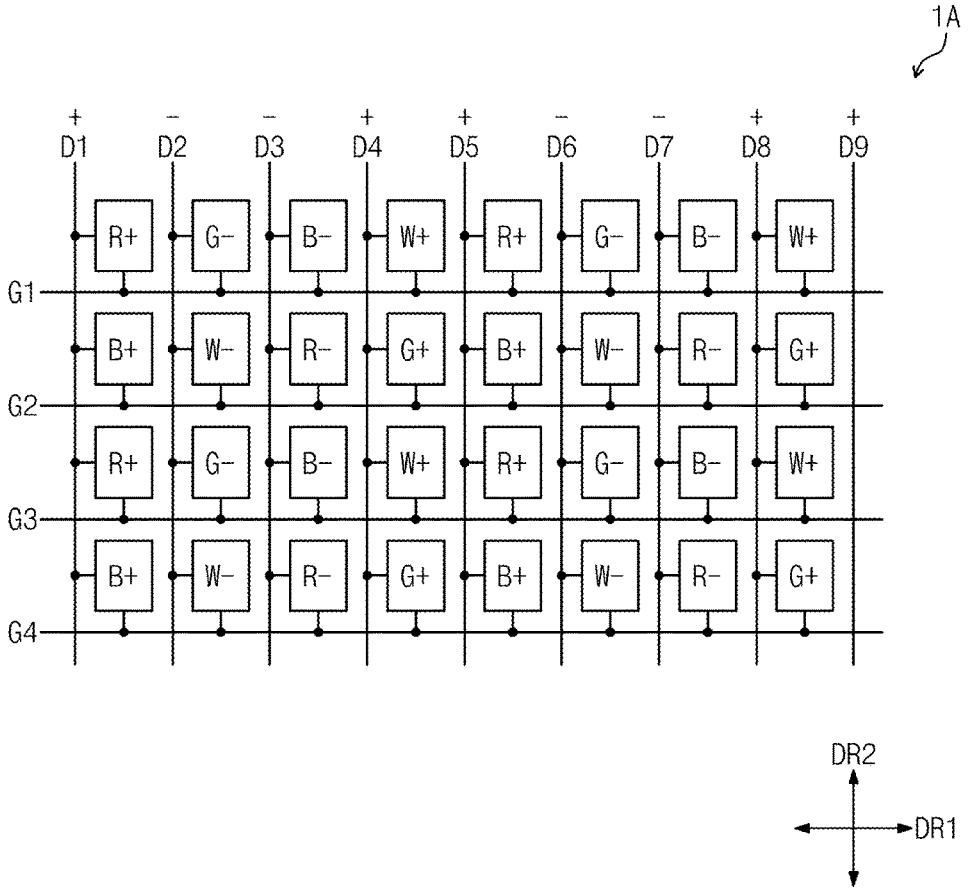
FIG. 4A is a plan view showing a portion of a liquid crystal panel according to a first comparison example.
Figure 4B:
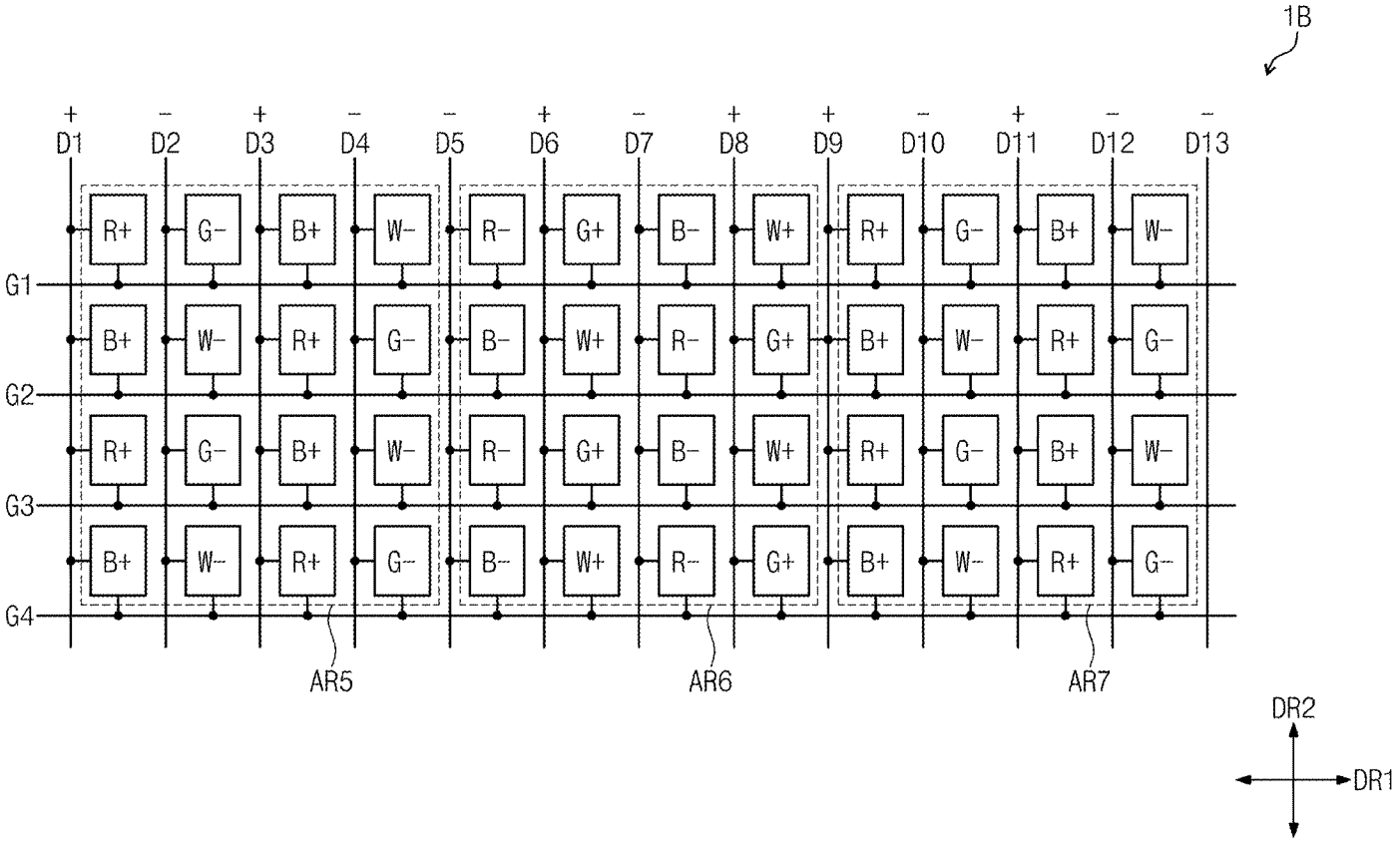
FIG. 4B is a plan view showing a portion of a liquid crystal panel according to a second comparison example.

FIG. 4A is a plan view showing a portion of a liquid crystal panel according to a first comparison example and FIG. 4B is a plan view showing a portion of a liquid crystal panel according to a second comparison example.

Hereinafter, the liquid crystal panels according to the first and second comparison examples will be described with reference to FIGS. 4A and 4B and effects of the liquid crystal panel 100 according to the present exemplary embodiment shown in FIG. 3 will be described.

Referring to FIGS. 4A and 4B, each of a first comparison liquid crystal panel 1A according to the first comparison example and a second comparison liquid crystal panel 1B according to the second comparison example includes a plurality of pixels. The pixels arranged in odd-numbered rows are arranged in order of red, green, blue, and white pixels, and the pixels arranged in even-numbered rows are arranged in order of blue, white, red, and green pixels.

Each of the pixels of the first and second comparison liquid crystal panels 1A and 1B is connected to a lower gate line and a left data line.

The polarities of the data voltages applied to the data lines D1 to D9 of the first comparison liquid crystal panel 1A are repeated in positive, negative, negative, and positive polarities. In detail, the polarities of the data voltages applied to the data lines D1 to D9 of the first comparison liquid crystal panel 1A are +, −, −, +, +, −, −, and +, respectively.

The polarities of the data voltages applied to the data lines D1 to D9 of the second comparison liquid crystal panel 1B are inverted every four data lines and the polarities of the data voltages are inverted every one data line in the four data lines. In detail, the polarities of the data voltages applied to the data lines D1 to D9 of the second comparison liquid crystal panel 1B are +, −, +, −, −, +, −, +, and +, respectively.

The polarities of the data voltages applied to the pixels of the first and second comparison liquid crystal panels 1A and 1B are inverted every frame period.

Figure 5:
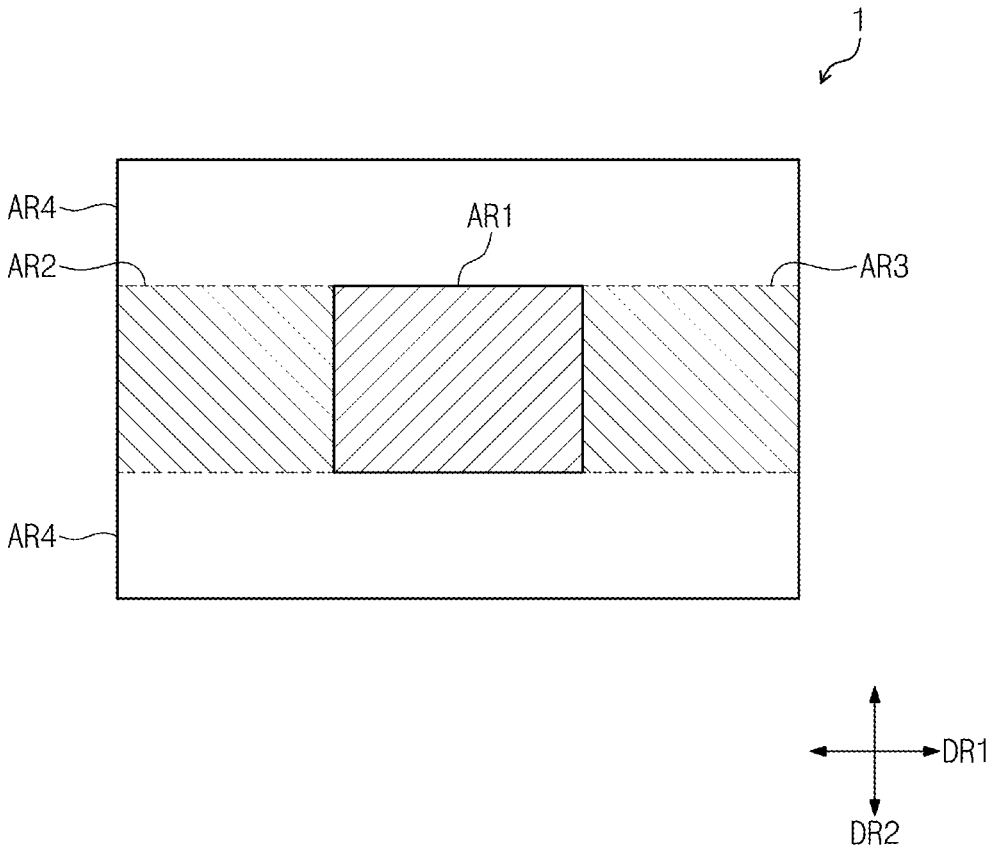
FIG. 5 is a view showing a liquid crystal panel in which a horizontal crosstalk occurs.

FIG. 5 is a view showing a liquid crystal panel 1 in which a horizontal crosstalk occurs.

The liquid crystal panel 1 shown in FIG. 5 displays a primary color, e.g., a red color, in a first area AR1.

When a sum of the polarities of the data voltages applied to the pixel displaying the primary color during one horizontal scan period 1H is biased to the positive or negative polarity, the common voltage is not constantly maintained due to a coupling phenomenon between the data lines and the common electrode. Accordingly, a ripple occurs in a positive or negative direction of the common voltage. In this case, the horizontal crosstalk, in which a difference in brightness between a peripheral area AR4 and second and third areas AR2 and AR3 adjacent to the first area AR1 displaying the primary color in the first direction DR1 is perceived, occurs in the second and third areas AR2 and AR3

Hereinafter, the red pixels of the first comparison liquid crystal panel 1A driven by the positive or negative data voltages will be described with reference to FIG. 4A. Referring to FIG. 4A, the red pixels R+ included in the pixels arranged in the first row of the first comparison liquid crystal panel 1A receive the positive data voltage during a first horizontal scan period 1H in response to the gate signal applied to the first gate line G1. In this case, the ripple occurs in the positive direction of the common voltage. In addition, the red pixels R− included in the pixels arranged in the second row of the first comparison liquid crystal panel 1A receive the negative data voltage during a second horizontal scan period 1H following the first horizontal scan period 1H in response to the gate signal applied to the second gate line G2. In this case, the ripple occurs in the negative direction of the common voltage.

The red pixels of the second comparison liquid crystal panel 1B are driven by the positive or negative data voltages will be described with reference to FIG. 4B. Referring to FIG. 4B, the second comparison liquid crystal panel 1B displays the red image in fifth and sixth areas AR5 and AR6 during the i-th frame period and displays the red image in sixth and seventh areas AR6 and AR7 during the (i+1)th frame period. In this case, a difference in brightness between the red pixel applied with the positive data voltage and the red pixel applied with the negative data voltage occurs, and as a result, a vertical line seems to move when the i-th frame period is changed to the (i+1)th frame period. The phenomenon that the vertical line seems to move is called a moving line-stain. The moving line-stain may occur not only in the pixels displaying specific colors but also in the pixels displaying the white color.

That is, the horizontal crosstalk occurs in the first comparison liquid crystal panel 1A shown in FIG. 4A and the moving line-stain occurs in the second comparison liquid crystal panel 1B shown in FIG. 4B.

Referring to FIG. 3 again, the red pixels R+ included in the pixels arranged in the first row of the liquid crystal panel 100 and the red pixels R− included in the pixels arranged in the second row of the liquid crystal panel 100 are driven in response to the gate signal applied to the second gate line G2 during one horizontal scan period.

The first and fifth data lines D1 and D5 are connected to the red pixels R+ arranged in the first row to apply the positive data voltage to the red pixels R+. The fourth and eight data lines D4 and D8 are connected to the red pixels R− arranged in the second row to apply the negative data voltage to the red pixels R−. That is, the polarities of the data voltages applied to the pixels to display the red color are offset with respect to each other during one horizontal period, and thus the ripple does not occur in the common voltage. Consequently, the horizontal crosstalk phenomenon may be improved.

In addition, since the pixels arranged in the same row and displaying the same color in the liquid crystal panel 100 shown in FIG. 3 receive the data voltages having the same polarity, the moving line-stain phenomenon may be improved. That is, the horizontal crosstalk phenomenon and the moving line-stain phenomenon may be improved.

Figure 6:
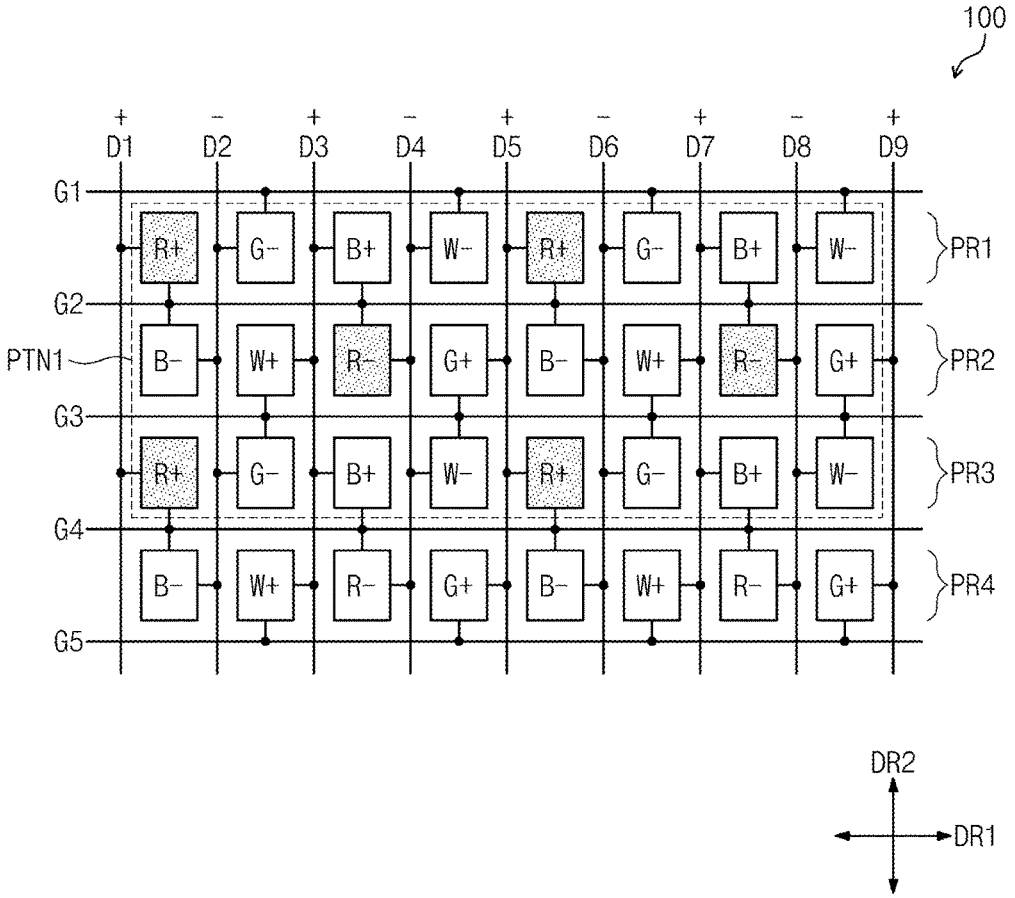
FIG. 6 is a view showing a first pattern of image data displayed through the liquid crystal panel shown in FIG. 3.

FIG. 6 is a view showing a first pattern PTN1 of the image data displayed through the liquid crystal panel 100 shown in FIG. 3.

Referring to FIGS. 1 and 6, the image data RGB display the first pattern PTN1 on the liquid crystal panel 100. According to the first pattern PTN1, the image is displayed in the first pixels, but not displayed in the second pixels among the first and second pixels commonly connected to one gate line. In detail, a boundary extending in the first direction DR1 of the first pattern PTN1 is disposed between the first pixels in the third pixel row PR3 and the second pixels in the fourth pixel row PR4. The first pattern PTN1 displays the image in the first pixels arranged in the third pixel row PR3 and does not display the image in the second pixels arranged in the fourth pixel row PR4.

Hereinafter, the red image displayed in the first to third pixel rows PR1 to PR3 is described as the first pattern PTN1 and a black image is displayed in red pixels in the fourth pixel row PR4 in which the first pattern PTN1 is not displayed. According to the display of the first pattern PTN1, the red pixels included in the first to third pixel rows PR1 to PR3 display the red image but the red pixels included in the fourth pixel rows PR4 display the black image.

During a time in which the gate signal is applied to the fourth gate line G4, the positive (+) data voltages are applied to the red pixels R+ arranged in the third pixel row PR3 and no voltages is applied to the red pixels R− arranged in the fourth pixel row PR4. Therefore, when the gate signal is applied to the fourth gate line G4, the ripple occurs in the positive direction of the common voltage and the horizontal crosstalk (one line crosstalk) occurs in one line shape.

Figure 7:
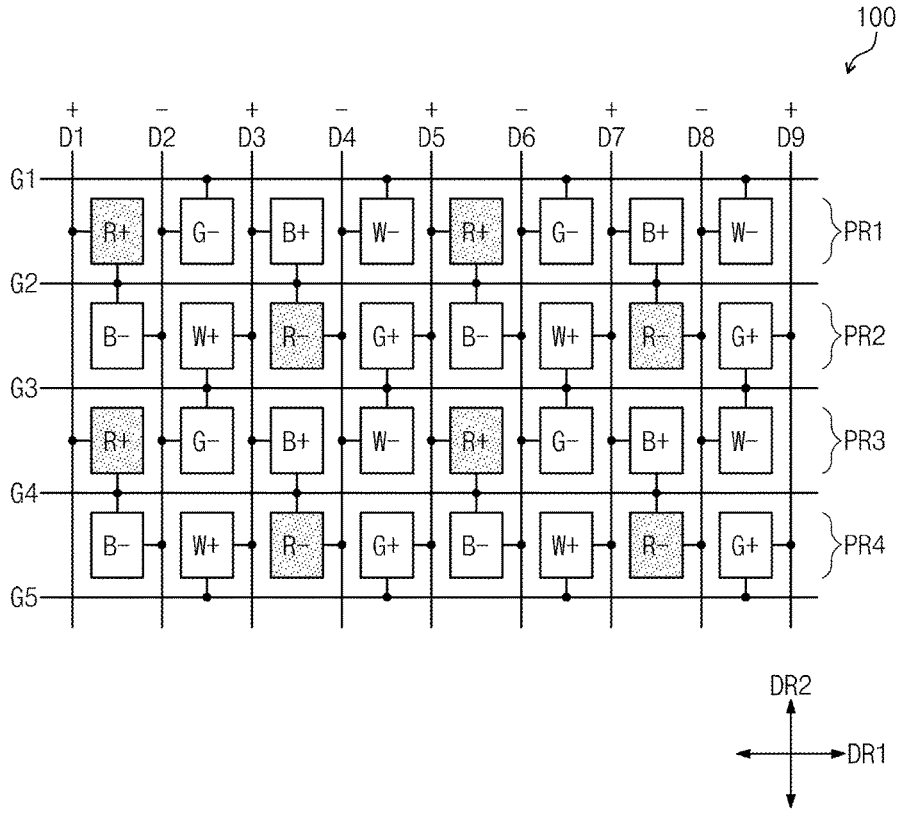
FIG. 7 is a view showing an image obtained by modulating the first pattern of the image data.

FIG. 7 is a view showing an image obtained by modulating the first pattern of the image data.

Referring to FIGS. 1, 6, and 7, when the image data RGB have the first pattern PTN1, the liquid crystal panel 100 applies the data voltages that are other than zero to the red pixels R− arranged in the fourth pixel row PR4. The data voltages applied to the red pixel R− arranged in the fourth pixel row PR4 are determine on the basis of the data voltages applied to the red pixels R+ arranged in the third pixel row PR3.

The timing controller 200 modulates the image data RGB when the image data RGB have the first pattern PTN1, and thus the data voltages that are other than zero are applied not only to the red pixels R+ arranged in the third pixel row PR3 but also to the red pixels R− arranged in the fourth pixel row PR4.

According to the present exemplary embodiment, when the image data RGB have the first pattern PTN1, the data voltages that are other than zero may be applied to the red pixels R− arranged in the fourth pixel row PR4. Since the red pixels R+ arranged in the third pixel row PR3 receive the data voltages having the polarity opposite to that of the data voltages applied to the red pixels R− arranged in the fourth pixel row PR4, the ripple may be prevented from occurring in the common voltage during the time in which the gate signal is applied to the fourth gate line G4. Thus, the one line crosstalk may be prevented from being generated.

Figure 8:
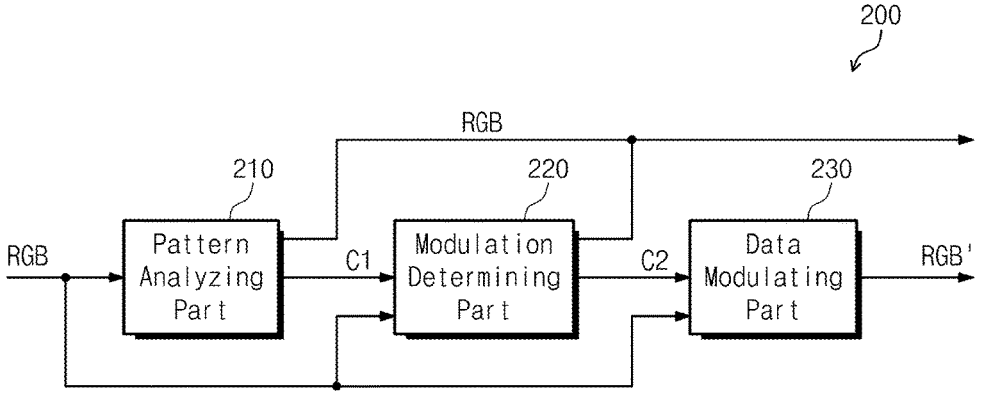
FIG. 8 is a block diagram showing a timing controller shown in FIG. 1.

FIG. 8 is a block diagram showing the timing controller 200 shown in FIG. 1.

Hereinafter, the timing controller 200 will be described in detail with reference to FIGS. 1 and 6 to 8.

Referring to FIG. 8, the timing controller 200 includes a pattern analyzing part 210, a modulating determining part 220, and a data modulating part 230.

The pattern analyzing part 210 analyzes the pattern of the image data RGB. The pattern analyzing part 210 analyzes whether the pattern of the image data RGB displays the image in the first pixels or the second pixels. The first and second pixels share one gate line, display the same color, and are disposed in different rows from each other. For instance, the pattern analyzing part 210 analyzes whether the pattern of the image data RGB displays the image in the first pixels and does not display the image in the second pixels. In other words, the pattern analyzing part 210 checks whether the boundary extending in the first direction DR1 of the pattern of the image data RGB is disposed between the first and second pixels.

According to the result of analyzing the pattern of the image data RGB, when the boundary extending in the first direction DR1 of the pattern of the image data RGB is not disposed between the first and second pixels, the pattern analyzing part 210 transmits the image data RGB without modulation.

According to the result of analyzing the pattern of the image data RGB, when the boundary extending in the first direction DR1 of the pattern of the image data RGB is disposed between the first and second pixels, the pattern analyzing part 210 outputs an analyzing signal C1. When the image data RGB have the first pattern PTN1 shown in FIG. 6, the boundary extending in the first direction DR1 of the first pattern PTN1 is disposed between the third pixel row PR3 and the fourth pixel row PR4, and thus the pattern analyzing part 210 outputs the analyzing signal C1.

The pattern analyzing part 210 analyzes the image data RGB using three by three mask filters and gets the boundary extending in the first direction DR1 of the pattern of the image data RGB. In detail, the pattern analyzing part 210 scan analyzes the image data RGB in the unit of data corresponding to the pixels arranged in three rows by three columns to get the boundary extending in the first direction DR1 of the pattern of the image data RGB on the basis of the analyzed result.

The modulating determining part 220 determines the modulation of the image data RGB in response to the analyzing signal C1.

The image data RGB may include first pixel data displayed in at least a portion of the first pixels and second pixel data displayed in at least a portion of the second pixels. When the image data RGB have the first pattern PTN1, the image data RGB include the first pixel data displayed in at least a portion of the red pixels arranged in the third pixel row and the second pixel data displayed in at least a portion of the red pixels arranged in the fourth pixel row PR4.

The first pixel data have a first grayscale value and the second pixel data have a second grayscale value different from the first grayscale value. When the image data RGB have the first pattern PTN1, the first grayscale value is not zero and the second grayscale value is zero.

The modulating determining part 220 checks whether the number of the first pixels in which the first pixel data are displayed is equal to or greater than a reference number. When the number of the first pixels in which the first pixel data are displayed is equal to or greater than the reference number, the modulation determining part 220 outputs a modulating signal C2 to modulate data. The reference number is determined depending on the number of the first pixels displaying the first pixel data, which causes the ripple in the common voltage. Instead of using the reference number, the modulating determining part 220 may check whether sum of gray voltages of the first pixels in which the first pixel data are displayed is equal to or greater than a reference voltage to decide whether the modulation determining part 220 outputs a modulating signal C2 to modulate data. The reference voltage of the first pixels is determined depending on the sum of gray voltages of the first pixels displaying the first pixel data, which causes the ripple in the common voltage.

According to FIG. 7, the number of the red pixels of the third pixel row PR3, in which the image is displayed, is two (2). When the reference number is one (1), the modulation determining part 220 outputs the modulating signal C2. In other words, when the image data RGB have the pattern causing the one line crosstalk, the modulation determining part 220 outputs the modulating signal C2.

The modulation determining part 220 outputs unmodulated image data RGB without changing the image data RGB when the number of the first pixels displaying the first pixel data or the sum of gray voltages of the first pixels is smaller than the reference number or the reference voltage, respectively.

The data modulating part 230 modulates the image data RGB in response to the modulation signal C2.

The data modulating part 230 modulates the first and second pixel data to allow the first and second pixel data have grayscale values between the first and second grayscale values.

The data modulating part 230 modulates the first pixel data to generate first modulated pixel data having a third grayscale value smaller than the first grayscale value. The data modulating part 230 modulates the second pixel data to generate second modulated pixel data having a fourth grayscale value. The third grayscale value may be equal to the fourth grayscale value. The data modulating part 230 outputs the modulated image data RGB' having the first and second modulated pixel data.

For instance, the first grayscale value may correspond to a highest brightness and the second grayscale value may correspond to a lowest brightness, e.g., a black color. The first pixels, in which the first pixel data are displayed, display the red at the highest brightness and the second pixels, in which the second pixel data are displayed, display the black. The data modulating part 230 modulates the first and second pixel data to generate the first and second modulated pixel data having the grayscale value corresponding to a half of the highest brightness. Each of the first pixels, in which the first modulated pixel data are displayed, and the second pixels, in which the second modulated pixel data are displayed, displays the red corresponding to the half of the highest brightness.

Each of the third and fourth grayscale values corresponds to a half of the sum of the first and second grayscale values. Accordingly, the brightness of the first and second pixels, in which the first and second pixel data area displayed, may be substantially the same as the brightness of the first and second pixels in which the first and second modulated pixel data are displayed. For instance, the brightness of the image displayed in the red pixels R+ arranged in the third pixel row PR3 shown in FIG. 6 may be substantially the same as a sum of the brightness of the image displayed in the red pixels R+ arranged in the third pixel row PR3 and the brightness of the image displayed in the red pixels R− arranged in the fourth pixel row PR4 shown in FIG. 7.

Among the red pixels R− arranged in the fourth pixel row PR4, the second pixel data displayed in the red pixels R− connected to the fourth data line D4 are generated on the basis of the first pixel data displayed in the red pixels R+ connected to the first and fifth data lines D1 and D5 among the red pixels R+ arranged in the third pixel row PR3, but they should not be limited thereto or thereby. That is, among the red pixels R− arranged in the fourth pixel row PR4, the second pixel data displayed in the red pixels R− connected to the fourth data line D4 are generated on the basis of the first pixel data displayed in the red pixels R+ connected to one of the first and fifth data lines D1 and D5 among the red pixels R+ arranged in the third pixel row PR3.

According to the present exemplary embodiment, when the boundary extending in the first direction DR1 of the pattern of the image data RGB is disposed between the first and second pixels and the number of the first pixels displaying the first pixel data or the sum of gray voltages of the first pixels is equal to or greater than the reference number or the reference voltage, respectively, the one line crosstalk may be prevented from occurring since the first and second pixels share the brightness of the image displayed in the first pixels.

Figure 9:
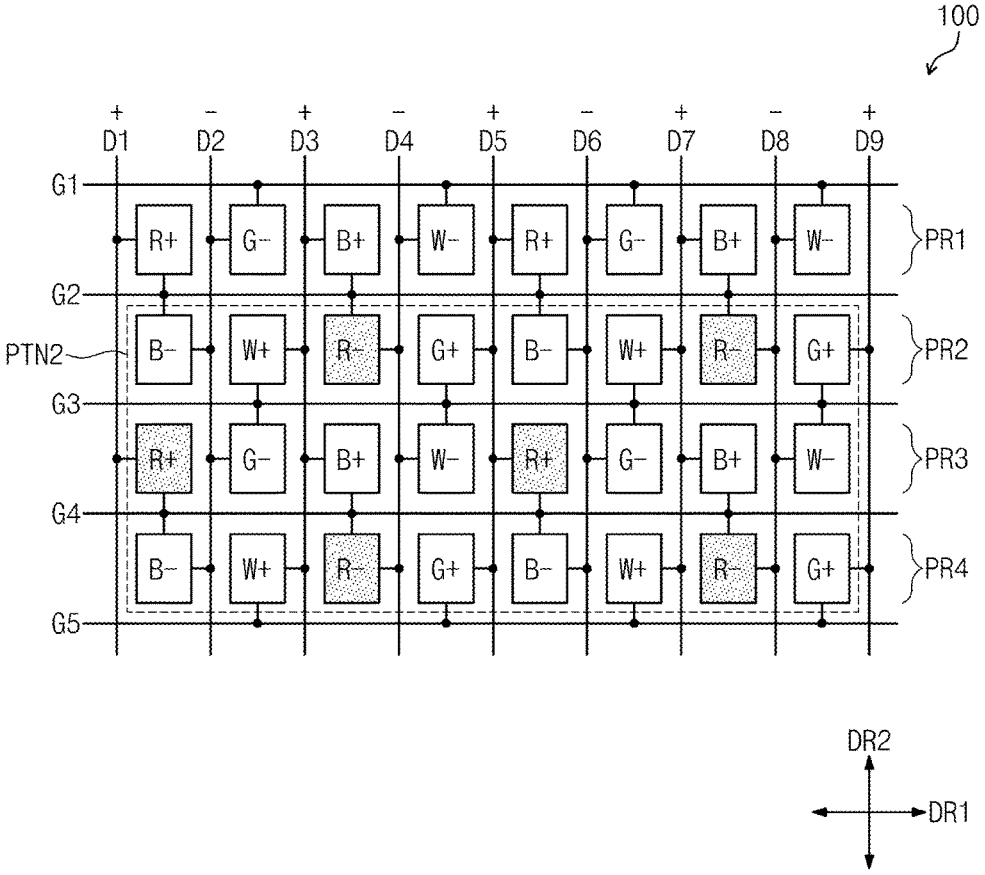
FIG. 9 is a view showing a second pattern of image data displayed through the liquid crystal panel shown in FIG. 3.
Figure 10:
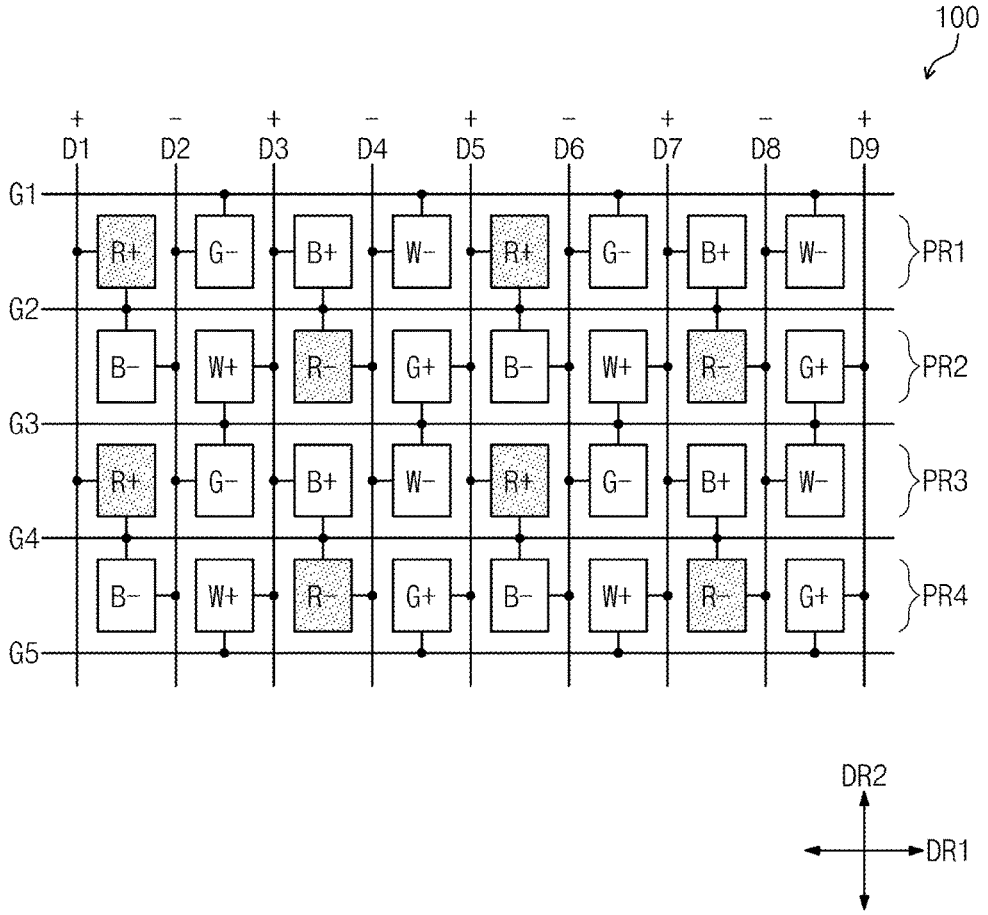
FIG. 10 is a view showing an image obtained by modulating the second pattern of the image data.

FIG. 9 is a view showing a second pattern PTN2 of the image data displayed through the liquid crystal panel shown in FIG. 3 and FIG. 10 is a view showing an image obtained by modulating the second pattern of the image data.

Referring to FIGS. 6 and 9, the second pattern PTN2 may include different pixels from those of the first pattern PTN1 and a boundary extending in the first direction DR1 of the second pattern PTN2 may be disposed between the first pixels in the second pixel row PR2 and the second pixels in the first pixel row PR1. Accordingly, similar to the first pattern PTN1, the one line crosstalk may occur in the second pattern PTN shown in FIG. 9.

Referring to FIGS. 1, 9, and 10, when the image data RGB have the second pattern PTN2, the liquid crystal panel 100 applies the data voltages that are other than zero to the second pixels, the red pixels R+ arranged in the first pixel row PR1. The data voltages applied to the red pixels R+ arranged in the first pixel row PR1 are determined on the basis of the data voltages applied to the red pixels R− arranged in the second pixel row PR2.

When the image data RGB have the second pattern PTN2, the timing controller 200 modulates the image data RGB to apply the data voltages that are other than zero not only to the red pixels R− arranged in the second pixel row PR2 but also the red pixels R+ arranged in the first pixel row PR1. The data modulation performed by the timing controller 200 is substantially similar to that described with reference to FIG. 8, and thus details thereof will be omitted.

According to the present exemplary embodiment, when the image data RGB have the second pattern PTN2, the data voltages that are other than zero may be applied to the red pixels R+ arranged in the first pixel row PR1. Since the red pixels R+ arranged in the first pixel row PR1 receive the data voltages having the polarity opposite to that of the data voltages applied to the red pixels R− arranged in the second pixel row PR2, the ripple may be prevented from occurring in the common voltage during the time in which the gate signal is applied to the first gate line G1. Thus, the one line crosstalk may be prevented from being generated.

Figure 11:
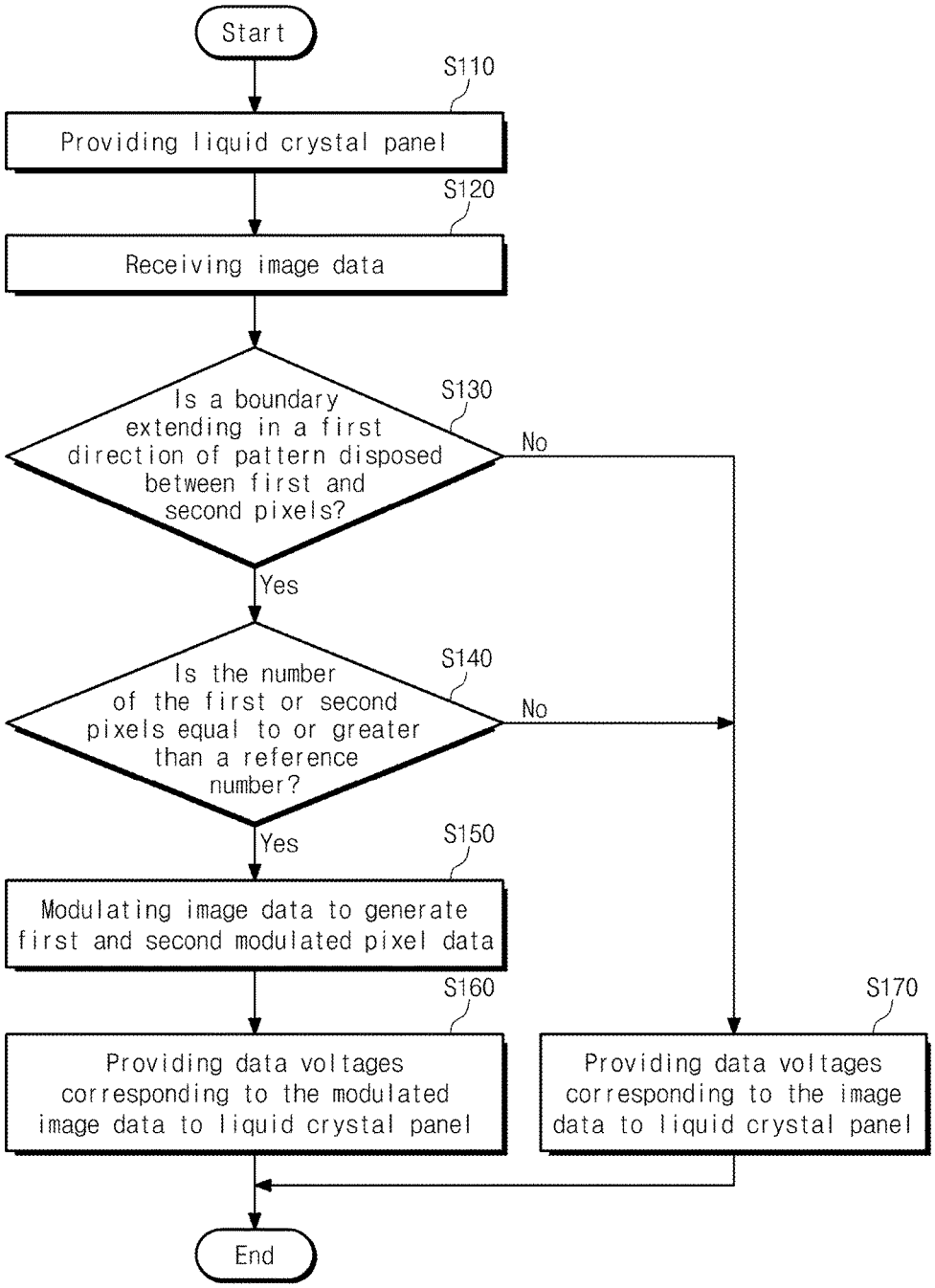
FIG. 11 is a flowchart showing a method of processing data of a display apparatus according to an exemplary embodiment of the present disclosure.

FIG. 11 is a flowchart showing a method of processing data of a display apparatus according to an exemplary embodiment of the present disclosure.

Referring to FIGS. 1, 3, 6, and 11, the liquid crystal panel 100 is provided (S110). The configurations of the liquid crystal panel 100 are as shown in FIG. 3, and thus details thereof will be omitted.

The timing controller 200 receives the image data RGB (S120).

Then, the timing controller 200 checks whether the boundary extending in the first direction DR1 of the pattern of the image data RGB is disposed between the first and second pixels (S130). The checking of the position of the boundary (S130) is performed by scan-analyzing the image data RGB in the unit of data corresponding to the pixels arranged in three rows by three columns. Through the checking of the position of the boundary (S130), the image data having the pattern causing the one line crosstalk are primarily determined.

When it is determined that the boundary extending in the first direction DR1 of the pattern of the image data RGB is not disposed between the first and second pixels (S130), the data voltages corresponding to the image data RGB are applied to the liquid crystal panel (S170). That is, the image data RGB are not modulated.

When it is determined that the boundary extending in the first direction DR1 of the pattern of the image data RGB is disposed between the first and second pixels (S130), it is determined whether the number of the first or second pixels displaying the pattern is equal to or greater than the reference number or the sum of gray voltages of the first pixels is greater than the reference voltage (S140). Through the checking of the number or the sum of gray voltages of the first or second pixels displaying the pattern (S140), the image data having the pattern causing the one line crosstalk are secondary determined.

When it is determined that the number of the first or second pixels displaying the pattern is smaller than the reference number or the sum of gray voltages of the first pixels is smaller than the reference voltage (S140), the data voltages corresponding to the image data RGB are applied to the liquid crystal panel (S170).

When it is determined that the number of the first or second pixels displaying the pattern is equal to or greater than the reference number or the sum of gray voltages of the first pixels is equal to or greater than the reference voltage (S140), the image data RGB are modulated (S150). The image data RGB include the first pixel data corresponding to the first pixels and having the first grayscale value and the second pixel data corresponding to the second pixels and having the second grayscale value. The first modulated pixel data having the third grayscale value between the first and second grayscale values to correspond to the first pixels and the second modulated pixel data having the fourth grayscale value between the first and second grayscale values to correspond to the second pixels are generated through the modulating of the image data RGB.

Then, the data voltages corresponding to the modulated image data are applied to the liquid crystal panel 100 (S160).

FIGS. 12 to 22 are plan views showing liquid crystal panels according to various exemplary embodiments of the present disclosure. In FIGS. 12 to 22, different features of the liquid crystal panels from those of the liquid crystal panel shown in FIG. 3 will be mainly described.

In the following embodiments, the polarities of the data voltages applied to the data lines are inverted every two data lines. In FIGS. 12 to 22, the polarities of the data voltages applied to the data lines are inverted in order of +, +, −, −, +, +, −, and −.

Different from the liquid crystal panel 100 shown in FIG. 3, each of the liquid crystal panels 100A to 100D shown in FIGS. 12 to 15 has a structure that the pixels arranged in the same column are alternately connected to two data lines adjacent thereto in the unit of two pixels. Referring to FIGS. 12 to 15, the pixels arranged in a u-th (u is a natural number) column disposed between a j-th (j is a natural number) data line and a (j+1)th data line are alternately connected to the j-th data line and the (j+1)th data line in the unit of two pixels.

Figure 12:
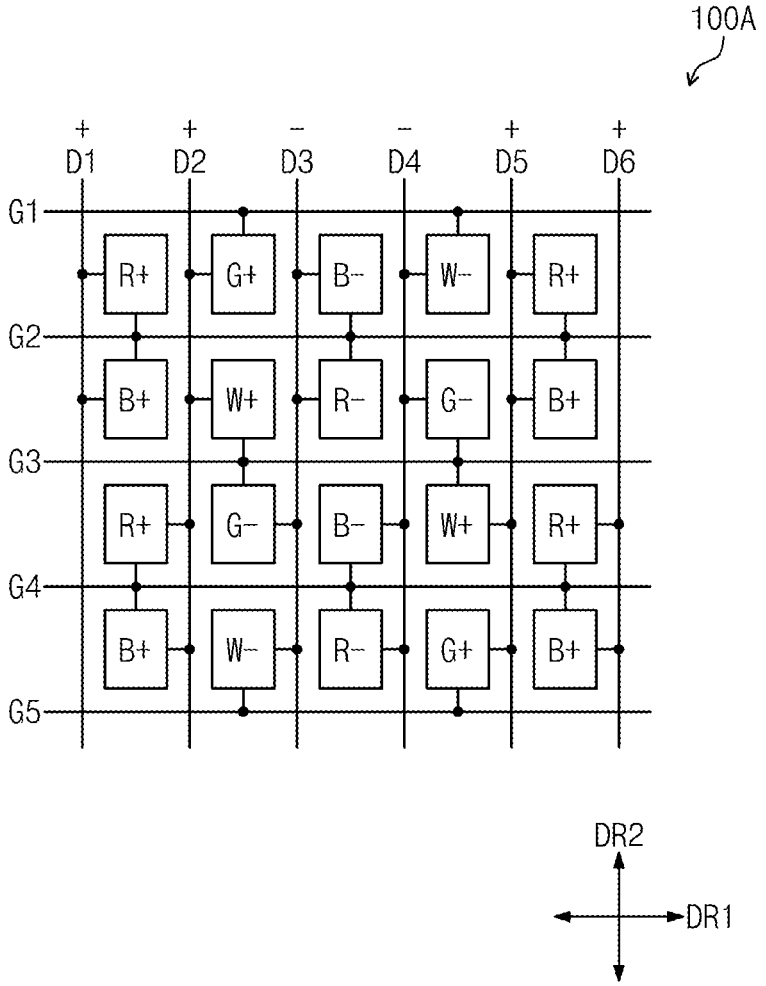
FIGS. 12, 13, 14, 15, 16, 17, 18, 19, 20, 21 and 22 are plan views showing liquid crystal panels according to various exemplary embodiments of the present disclosure.
Figure 13:
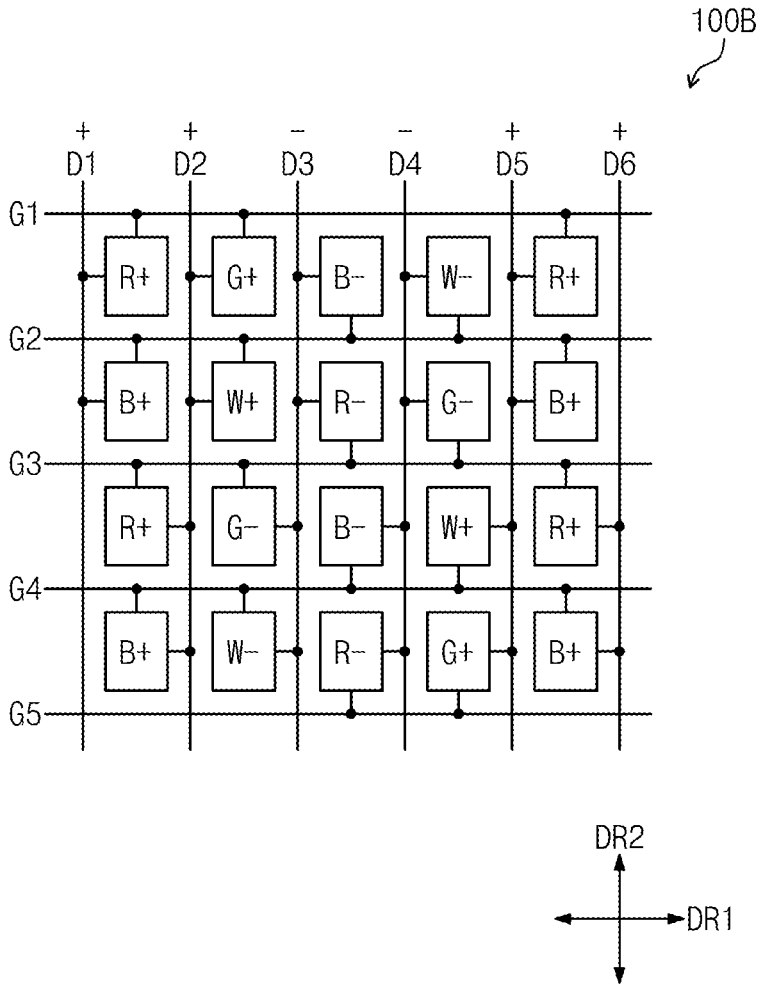
Figure 14:
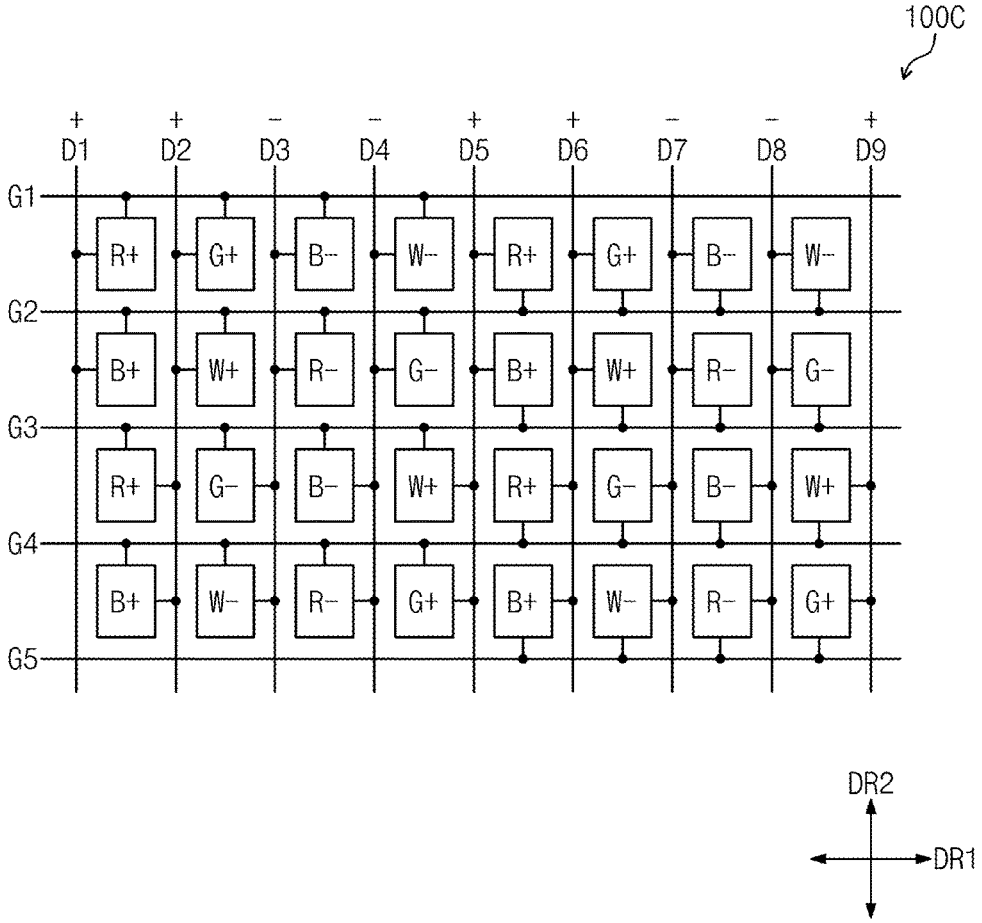
Figure 15:
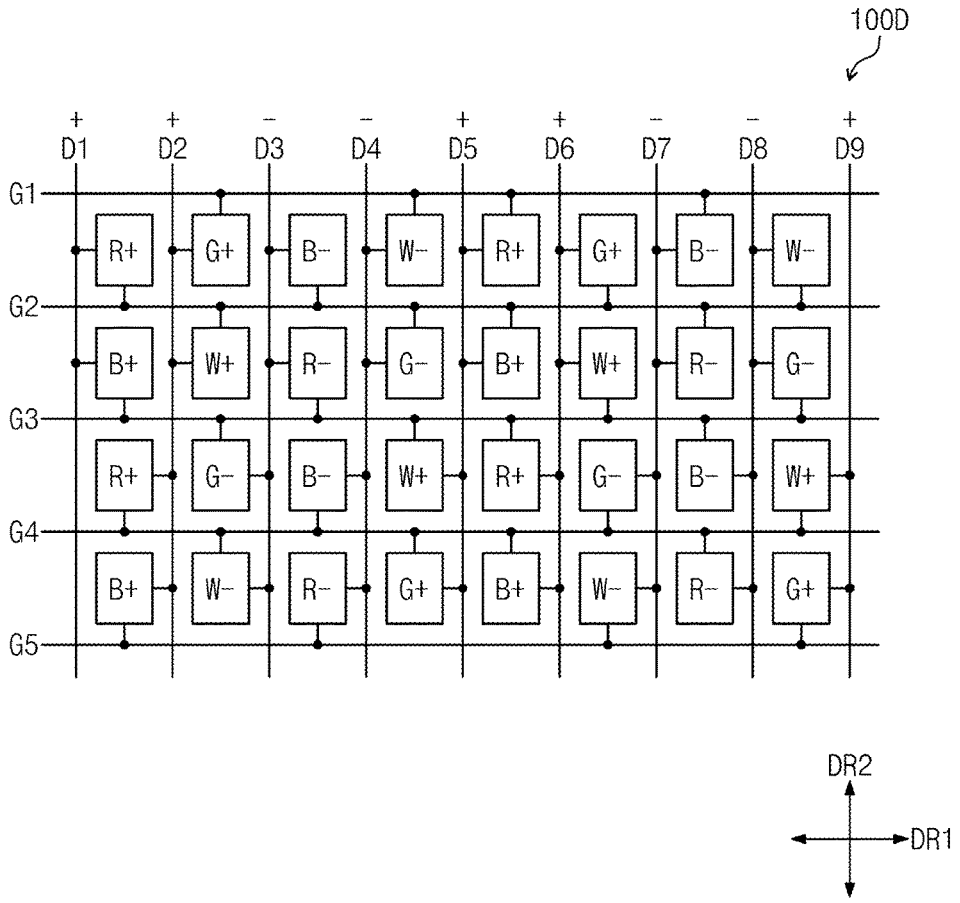
Figure 16:
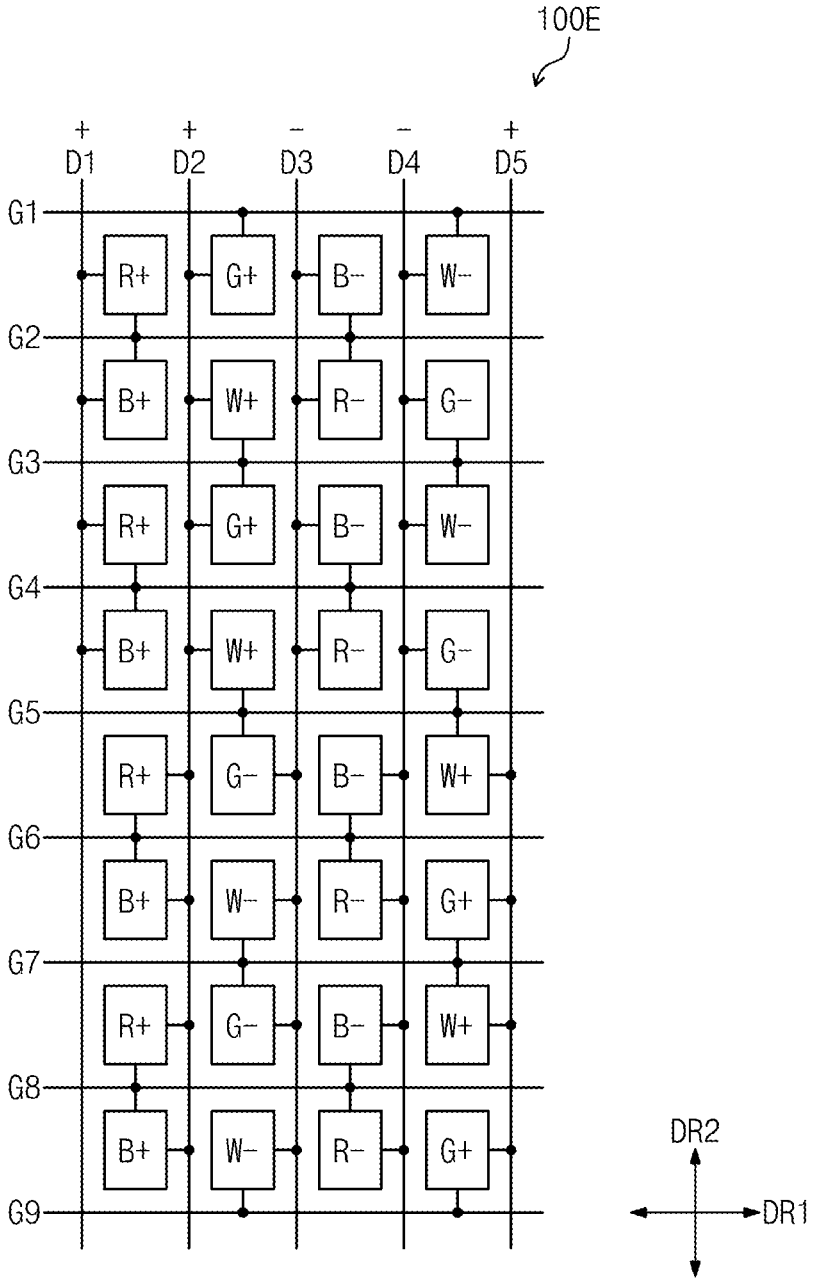
Figure 17:
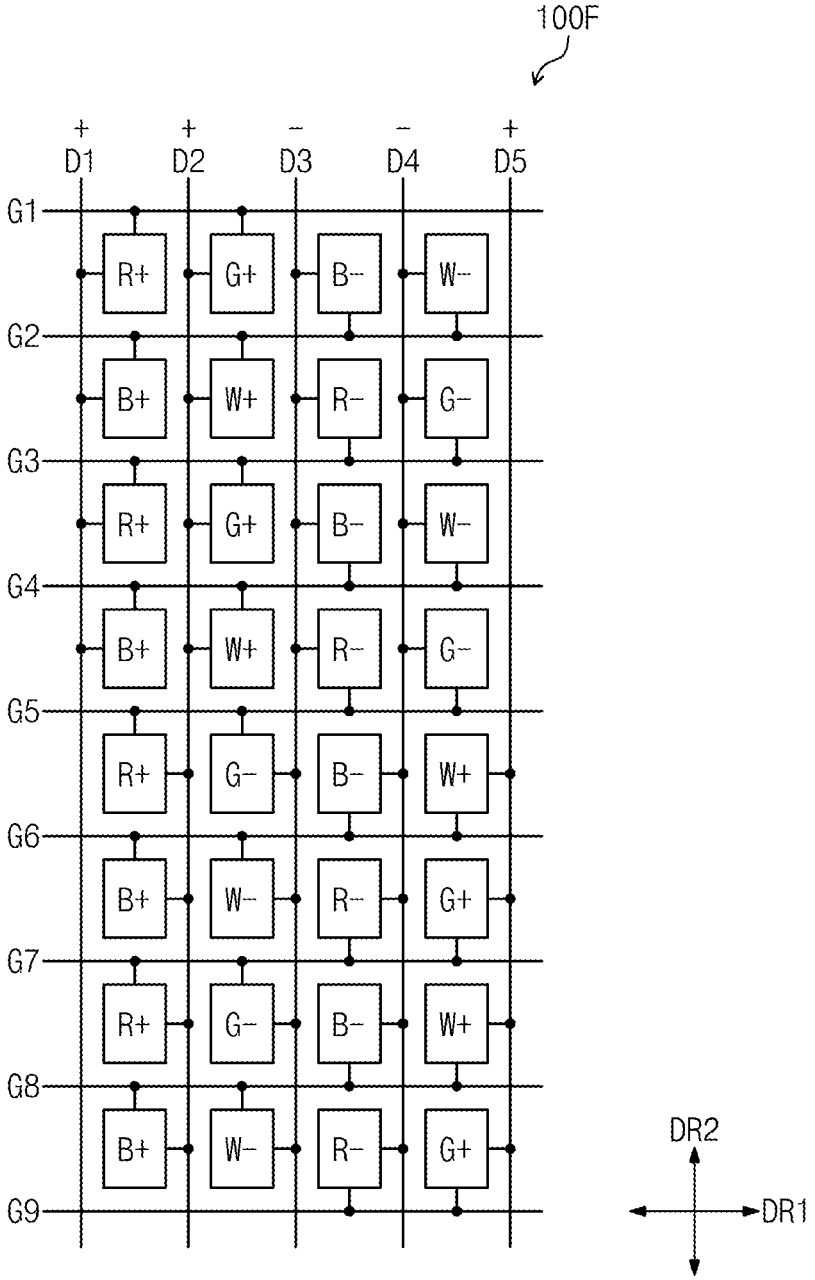
Figure 18:
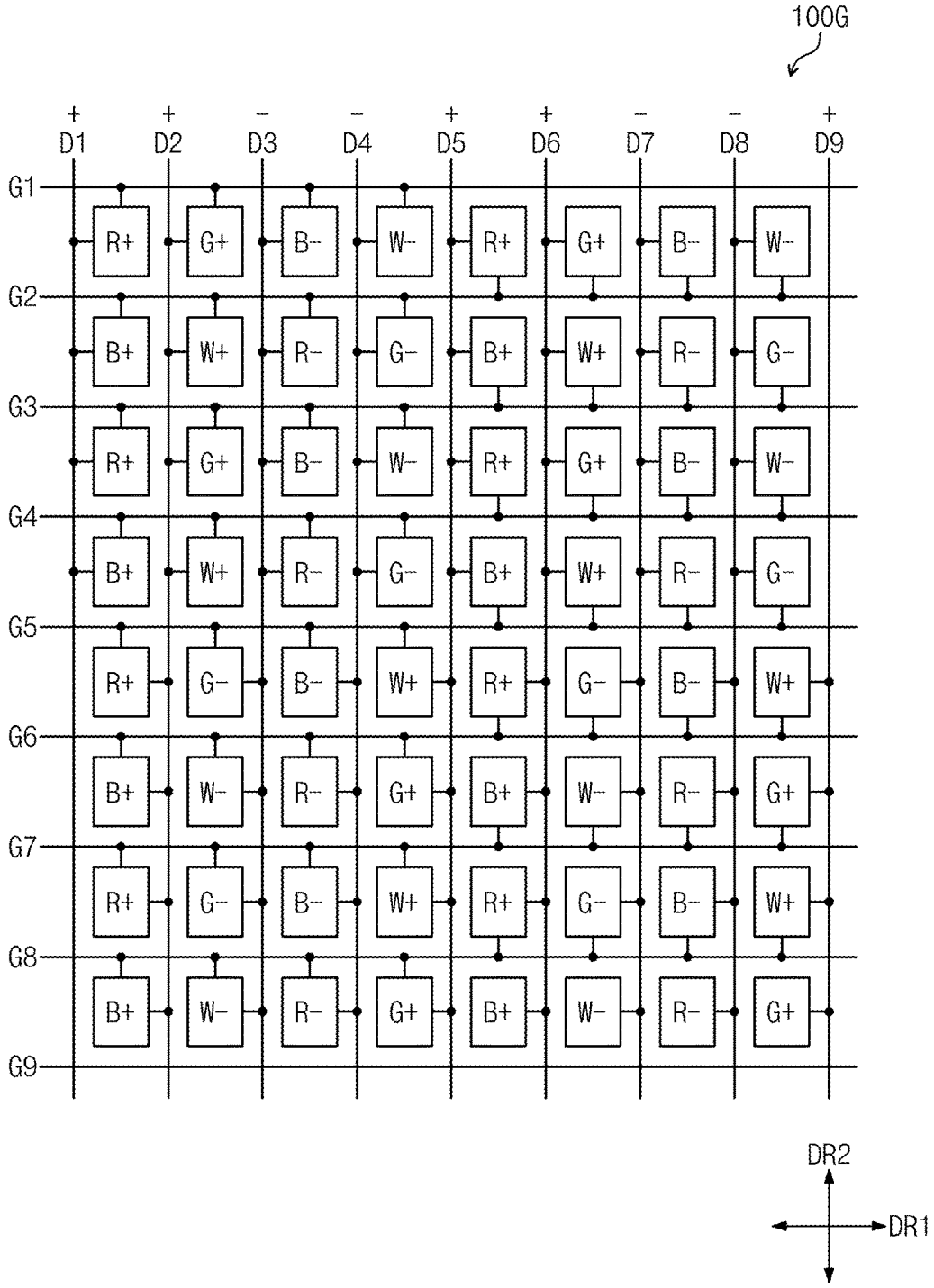
Figure 19:
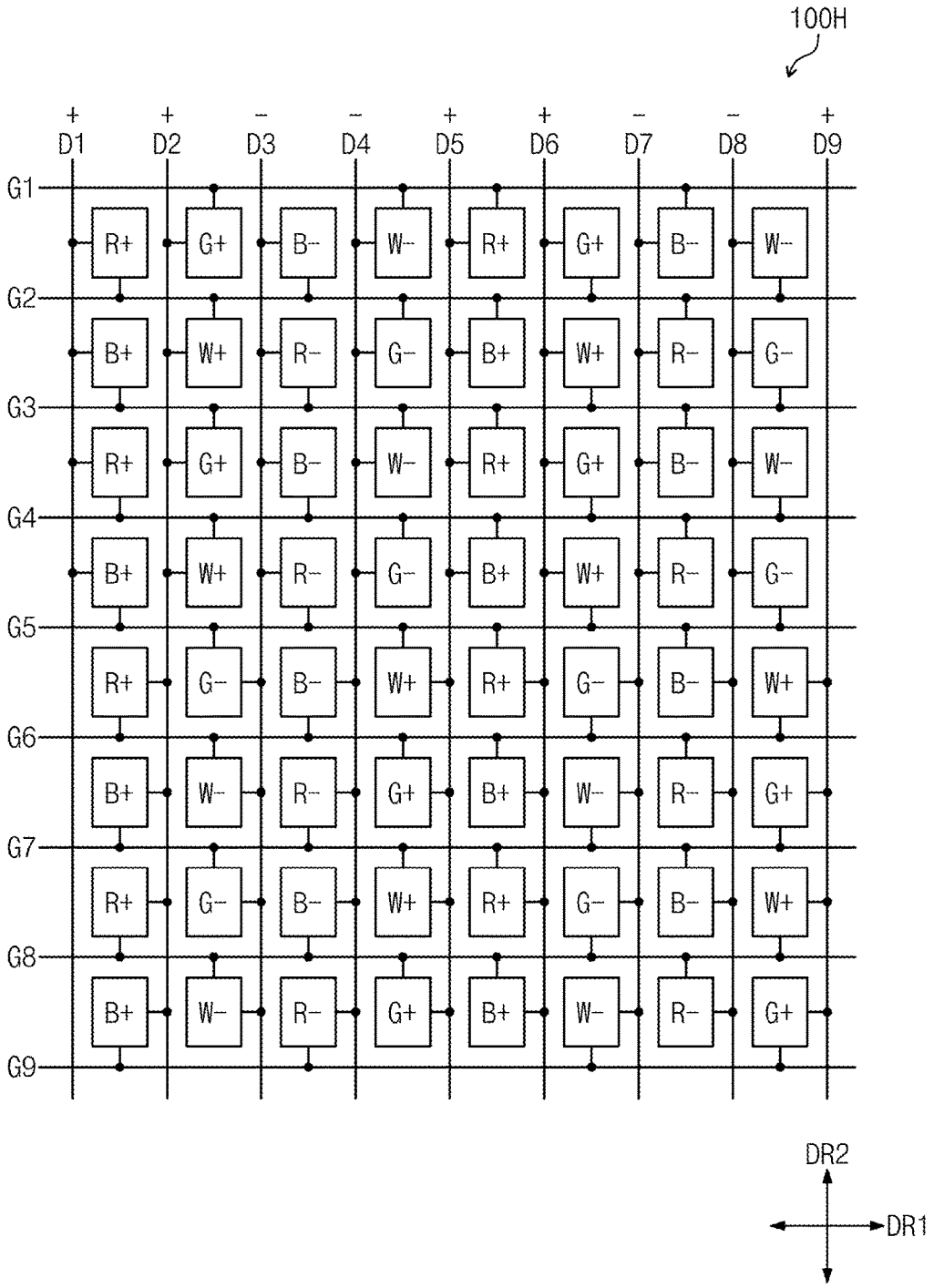

Different from the liquid crystal panel 100 shown in FIG. 3, each of the liquid crystal panels 100B to 100D shown in FIGS. 13 to 15 has a structure that the pixels arranged in the same column are alternately connected to two data lines adjacent thereto in the unit of two pixels. Referring to FIGS. 12 to 15, the pixels arranged in a h-th row disposed between a k-th gate line and a (k+1)th gate line are alternately connected to the k-th gate line and the (k+1)th gate line in the unit of at least one pixel.

Referring to FIG. 12, the pixels arranged in the h-th row disposed between the k-th gate line and the (k+1)th gate line of the liquid crystal panel 100A are alternately connected to the k-th gate line and the (k+1)th gate line in the unit of one pixel.

Referring to FIG. 13, the pixels arranged in the h-th row disposed between the k-th gate line and the (k+1)th gate line of the liquid crystal panel 100B are alternately connected to the k-th gate line and the (k+1)th gate line in the unit of two pixels.

Referring to FIG. 14, the pixels arranged in the h-th row disposed between the k-th gate line and the (k+1)th gate line of the liquid crystal panel 100C are alternately connected to the k-th gate line and the (k+1)th gate line in the unit of four pixels.

Referring to FIG. 15, the pixels arranged in the h-th row disposed between the k-th gate line and the (k+1)th gate line of the liquid crystal panel 100D are alternately connected to the k-th gate line and the (k+1)th gate line, and the gate line, to which each of the pixels arranged in the h-th row disposed between the k-th gate line and the (k+1)th gate line of the liquid crystal panel 100D is connected, is changed to the k-th or (k+1)th gate line in the unit of four pixels.

Each of the liquid crystal panels 100E to 100H shown in FIGS. 16 to 19 has the same structure and function as those of the liquid crystal panels 100A to 100D shown in FIGS. 12 to 15 except that the pixels arranged in the same column are alternately connected to two data lines adjacent thereto in the unit of four pixels.

Figure 20:
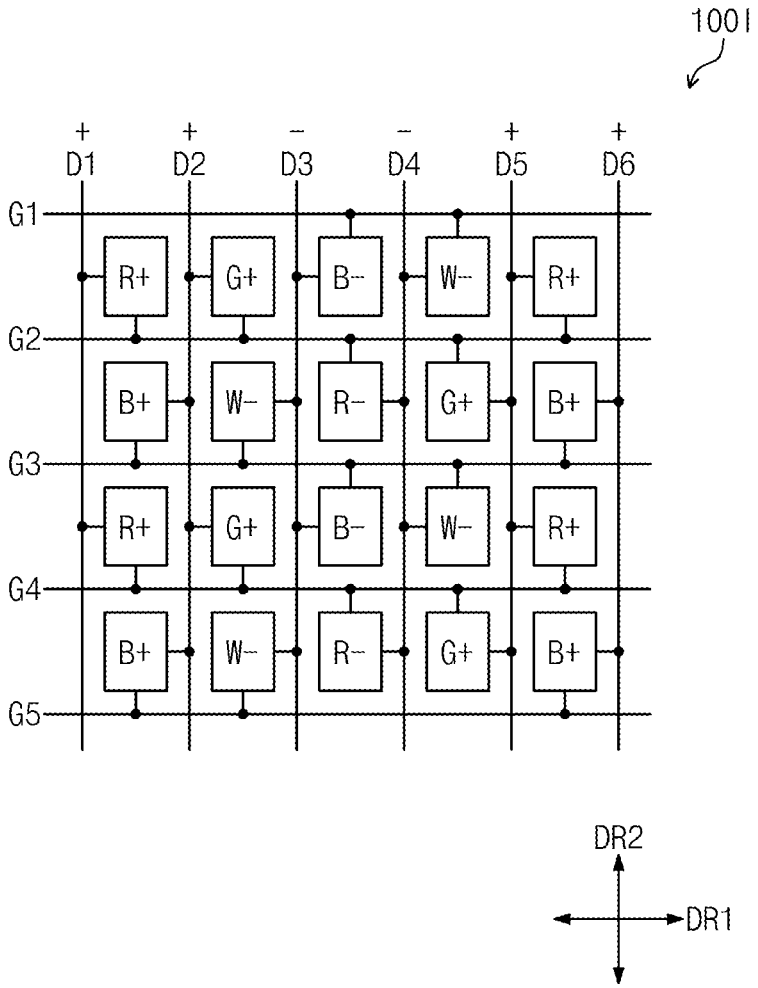
Figure 21:
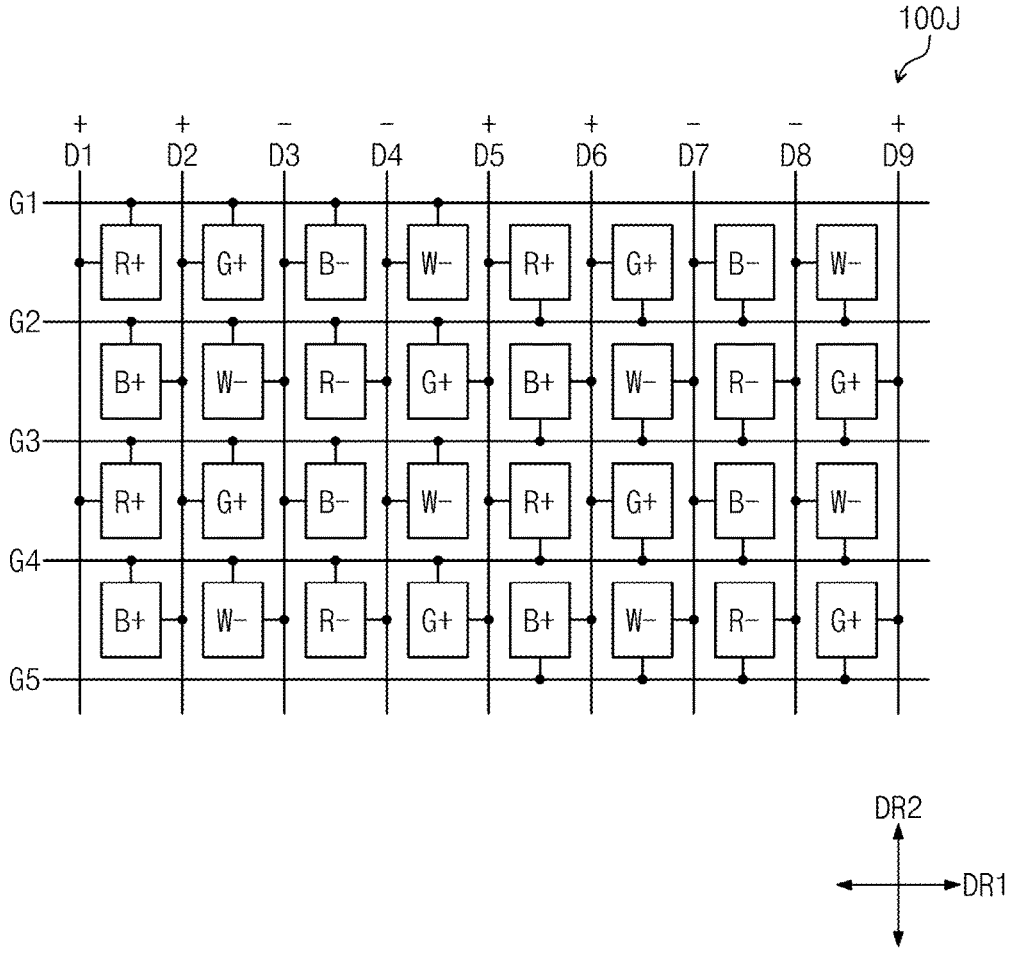
Figure 22:
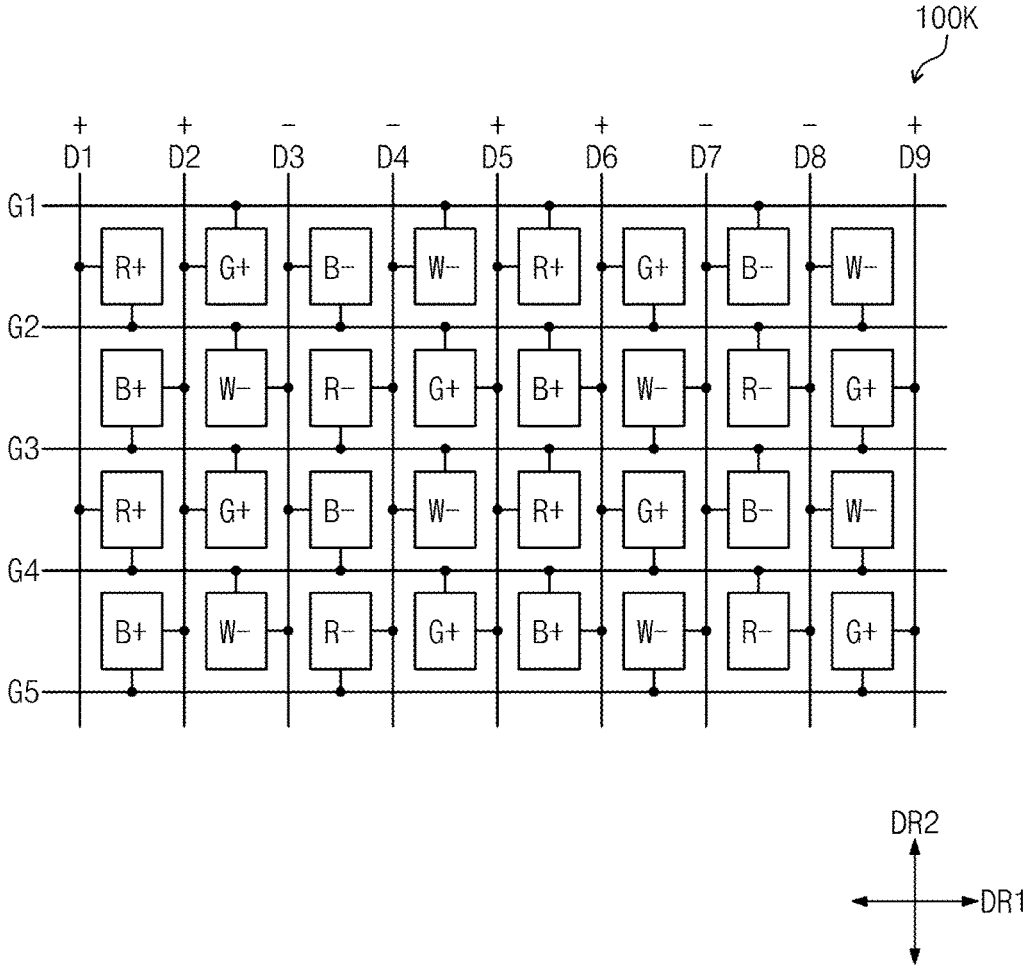

Each of the liquid crystal panels 1001 to 100K shown in FIGS. 20 to 22 has the same structure and function as those of the liquid crystal panels 100B to 100D shown in FIGS. 13 to 15 except that the pixels arranged in the same column are alternately connected to two data lines adjacent thereto in the unit of one pixel.

Each of the liquid crystal panels 100A to 100K shown in FIGS. 12 to 22 may improve the horizontal crosstalk phenomenon and the moving line-stain phenomenon.

Although the exemplary embodiments of the present inventive concept have been described, it is understood that the present inventive concept should not be limited to these exemplary embodiments but various changes and modifications can be made by one ordinary skilled in the art within the spirit and scope of the present inventive concept as hereinafter claimed.

What is claimed is:

1. A display apparatus comprising:

a liquid crystal panel comprising a plurality of gate lines extending in a first direction, a plurality of data lines extending in a second direction crossing the first direction, and a plurality of pixels connected to the gate lines and the data lines;

a gate driver applying gate signals to the gate lines;

a data driver applying data voltages to the data lines; and a timing controller receiving a control signal and image data to apply a gate control signal to the gate driver and to apply a data control signal to the data driver, wherein the pixels comprise pixels arranged in a h-th (h is a natural number) row and pixels arranged in a (h+1)th row, which are adjacent to each other in the second direction such that a (k+1)th (k is a natural number) of the gate lines is disposed between the pixels arranged in the h-th row and the pixels arranged in the (h+1)th row, first pixels displaying a first color and-connected to the (k+1)th gate line among the pixels arranged in the h-th row, and second pixels displaying the first color and-connected to the (k+1)th gate line among the pixels arranged in the (h+1)th row, are spaced apart from each other in the first direction and receive data voltages having different polarities, the image data comprise first pixel data displayed in at least a portion of the first pixels and second pixel data displayed in at least a portion of the second pixels, and when a boundary of a pattern extending in the first direction is disposed between the first and second pixels and the first pixel data have a first grayscale value and the second pixel data have a second grayscale value different from the first grayscale value, the timing controller modulates the first pixel data to be provided to the first pixels to have a grayscale value between the first and second grayscale values and modulates the second pixel data to be provided to the second pixels to have a grayscale value between the first and second grayscale values.

2. The display apparatus of claim 1, wherein the timing controller modulates the first pixel data to generate first modulated pixel data having a third grayscale value different from the first and second grayscale values and modulates the second pixel data to generate second modulated pixel data having the third grayscale value.

3. The display apparatus of claim 2, wherein the third grayscale value corresponds to a half of a sum of the first and second grayscale values.

4. The display apparatus of claim 1, wherein the timing controller comprises:

a pattern analyzing part configured to analyze the pattern of the image data and determining whether the boundary of the pattern extending in the first direction is disposed between the first and second pixels;

a modulation determining part configured to determine whether a number of the first pixels displaying the pattern or a number of the second pixels displaying the pattern is equal to or greater than a reference number; and a data modulating part configured to modulate the first and second pixel data.

5. The display apparatus of claim 4, wherein the data modulating part modulates the first and second pixel data when the boundary extending in the first direction of the pattern is disposed between the first and second pixels and the number of the first pixels displaying the pattern or the number of the second pixels displaying the pattern is equal to or greater than the reference number.

6. The display apparatus of claim 4, wherein the data modulating part does not modulate the first and second pixel data when the boundary extending in the first direction of the pattern is not disposed between the first and second pixels or when the number of the first pixels displaying the pattern or the number of the second pixels displaying the pattern is smaller than the reference number.

7. The display apparatus of claim 4, wherein, when the first grayscale value is not zero and the second grayscale value is zero, the modulation determining part checks whether the number of the first pixels displaying the pattern is equal to or greater than the reference number, and when the second grayscale value is not zero and the first grayscale value is zero, the modulation determining part checks whether the number of the second pixels displaying the pattern is equal to or greater than the reference number.

8. The display apparatus of claim 1, wherein the first color is a red, green, blue, or white color.

9. The display apparatus of claim 1, wherein the pixels arranged in the h-th row comprise a first pixel group and a second pixel group, which are sequentially arranged in the first direction, the pixels arranged in the (h+1)th row comprise a third pixel group and a fourth pixel group, which are sequentially arranged in the first direction, and each of the first, second, third, and fourth pixel groups comprises an even number of pixels.

10. The display apparatus of claim 9, wherein each of the first and fourth pixel groups comprises two pixels of a red pixel, a green pixel, a blue pixel, and a white pixel, and each of the second and third pixel groups comprises the other two pixels of the red pixel, the green pixel, the blue pixel, and the white pixel.

11. The display apparatus of claim 1, wherein the second pixels are included in the pixels arranged in a (2u+1)th (u is a natural number) column when the first pixels are included in the pixels arranged in a (2u−1)th column, and when the first pixels are included in the pixels arranged in a 2u-th column, the second pixels are included in the pixels arranged in a (2u+2)th column.

12. The display apparatus of claim 1, wherein, among the pixels arranged in the (2u−1)th (u is a natural number) column, two pixels adjacent to each other in the second direction such that a 2k-th gate line is disposed between the two pixels are commonly connected to the 2k-th gate line, and among the pixels arranged in the 2u-th column, two pixels adjacent to each other in the second direction such that a (2k−1)th gate line is disposed between the two pixels are commonly connected to the (2k−1)th gate line.

13. The display apparatus of claim 1, wherein, among the pixels arranged in the (2u−1)th (u is a natural number) column, two pixels adjacent to each other in the second direction such that a (2k−1)th gate line is disposed between the two pixels are commonly connected to the (2k−1)th gate line, and among the pixels arranged in the 2u-th column, two pixels adjacent to each other in the second direction such that a 2k-th gate line is disposed between the two pixels are commonly connected to the 2k-th gate line.

14. The display apparatus of claim 1, wherein the pixels arranged in a u-th (u is a natural number) column, which is disposed between a j-th (j is a natural number) and a (j+1)th data line of the data lines, are alternately connected to the j-th data line and the (j+1)th data line in the unit of at least one pixel.

15. The display apparatus of claim 14, wherein the polarity of the data voltages applied to the data lines is inverted every at least one data line.

16. The display apparatus of claim 14, wherein the pixels arranged in the h-th row, which is disposed between a k-th gate line and a (k+1)th gate line of the gate lines, are alternately connected to the k-th gate line and the (k+1)th gate line in the unit of at least one pixel.

17. The display apparatus of claim 1, wherein the timing controller comprises:

a pattern analyzing part configured to analyze a pattern of the image data and determining whether a boundary of the pattern extending in the first direction is disposed between the first and second pixels;

a modulation determining part configured to determine whether sum of gray voltage of the first pixels displaying the pattern or sum of gray voltage of the second pixels displaying the pattern is equal to or greater than a reference voltage; and a data modulating part configured to modulate the first and second pixel data.

18. A method of processing data of a display apparatus, comprising:

providing a liquid crystal panel comprising a plurality of gate lines extending in a first direction, a plurality of data lines extending in a second direction crossing the first direction, and a plurality of pixels connected to the gate lines and the data lines, the pixels comprising pixels arranged in a h-th (h is a natural number) row and pixels arranged in a (h+1)th row, which are adjacent to each other in the second direction such that a (k+1)th (k is a natural number) of the gate lines is disposed between the pixels arranged in the h-th row and the pixels arranged in the (h+1)th row, first pixels displaying a first color and connected to the (k+1)th gate line among the pixels arranged in the h-th row, and second pixels displaying the first color and connected to the (k+1)th gate line among the pixels arranged in the (h+1)th row, being spaced apart from each other in the first direction and receiving data voltages having different polarities;

determining whether a boundary extending in the first direction of a pattern of the image data is disposed between the first and second pixels;

determining whether a number of the first pixels displaying the pattern or a number of the second pixels displaying the pattern is equal to or greater than a reference number when the boundary extending in the first direction of the pattern of the image data is disposed between the first and second pixels; and modulating the image data comprising first pixel data corresponding to the first pixels and having a first grayscale value and second pixel data corresponding to the second pixels and having a second grayscale value when the number of the first pixels or the second pixels displaying the pattern of the image data is equal to or greater than the reference number to generate first modulated pixel data to be provided to the first pixels to have a third grayscale value between the first and second values and second modulated pixel data to be provided to the second pixels to have a fourth grayscale value between the first and second grayscale values, wherein the image data are not modulated when the boundary extending in the first direction of the pattern of the image data is not disposed between the first and second pixels or the number of the first pixels displaying the pattern or the number of the second pixels displaying the pattern is smaller than the reference number.

19. The method of claim 18, wherein the third grayscale value is substantially equal to the fourth grayscale value.

* * * * *